US008048008B2

(12) United States Patent
Yasuhara et al.

(10) Patent No.: US 8,048,008 B2
(45) Date of Patent: Nov. 1, 2011

(54) MOTION ASSIST DEVICE

(75) Inventors: Ken Yasuhara, Wako (JP); Kei Shimada, Wako (JP); Yosuke Endo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 77 days.

(21) Appl. No.: 12/681,329

(22) PCT Filed: Aug. 19, 2008

(86) PCT No.: PCT/JP2008/002233

§ 371 (c)(1),
(2), (4) Date: Apr. 1, 2010

(87) PCT Pub. No.: WO2009/044501

PCT Pub. Date: Apr. 9, 2009

(65) Prior Publication Data

US 2010/0234775 A1 Sep. 16, 2010

(30) Foreign Application Priority Data

Oct. 2, 2007 (JP) ..... 2007-259175

(51) Int. Cl.
*A61H 1/00* (2006.01)
*A61H 1/02* (2006.01)
*A61H 5/00* (2006.01)

(52) U.S. Cl. ..... 601/35; 601/5

(58) Field of Classification Search ..... 601/5, 33–35; 602/16, 23–25; 623/25, 30; 331/65; 600/595
See application file for complete search history.

(56) References Cited

U.S. PATENT DOCUMENTS

2005/0177080 A1* 8/2005 Yasuhara et al. ..... 602/16
2008/0249438 A1* 10/2008 Agrawal et al. ..... 601/35

FOREIGN PATENT DOCUMENTS

JP 2004-073649 3/2004
JP 2007-061217 3/2007

* cited by examiner

*Primary Examiner* — Kristen Matter
(74) *Attorney, Agent, or Firm* — Rankin, Hill & Clark LLP

(57) ABSTRACT

The motion assist device (200) is provided with an auxiliary oscillator generation element (150) configured to generate, on the basis of a second intrinsic angular velocity ($\omega_2$) set according to a first oscillator ($\xi_1$) generated from a first motion oscillator ($\phi_1$) and a first model and a second oscillator ($\xi_2$) generated from a second motion oscillator ($\phi_2$) and a second model, an auxiliary oscillator ($\eta$) which includes therein a first auxiliary oscillator ($\eta_1$) denoting an elastic force originated from a virtual elastic element for assisting the motion of the user so as to approximate a value of a third motion oscillator ($\phi_3$) to a desired value ($\phi_{0+}$, $\phi_{0-}$) related to a desired motion scale of the user, and an auxiliary oscillator regulation element (160) configured to sequentially regulate the first auxiliary oscillator ($\eta_1$) so as to approximate a motion index value of the user to a reference value.

6 Claims, 5 Drawing Sheets

MOTION ASSIST DEVICE

PRIORITY CLAIM

The present application is based on and claims the priority benefit of Japanese Patent Application 2007-259175 filed on Oct. 2, 2007, the contents of which are incorporated herein by reference in its entirety.

BACKGROUND OF THE INVENTION

1. Field of the Invention

The present invention relates to a motion assist device for assisting a user in motion.

2. Description of the Related Art

In recent years, there has been proposed a device which assists a user in walk motion by applying a torque around a joint (a hip joint, a knee joint or an ankle joint) of a leg with respect to the body of the user. A control system has been disclosed for this kind of the walk assist device to maintain autonomy in a walk guiding rhythm of the walk assist device while following the variation of the walk motion rhythm of the user (refer to Patent Document 1: Japanese Patent Laid-open No. 2004-73649).

However, in the device according to Patent Document 1, it is possible that a footstep or an angle of a leg joint becomes excessively great or small due to excessively insufficient assist force or excessively insufficient action distance thereof even though a walk assist rhythm of the walk assist device is appropriate. In other words, although the motion rhythm of the user for guiding the motion of the user is consistent with a desired motion rhythm, the assist force or the action distance for guiding the motion of the user may make a motion scale of the user deviate from a desired motion scale, which applies uncomfortable feeling or the like to the user. In this regard, there has bee disclosed a device capable of assisting a user in motion by matching the motion rhythm of the user to a desired motion rhythm thereof and matching the motion scale of the user to a desired motion scale thereof (refer to Patent Document 2: Japanese Patent Laid-open No. 2007-61217).

According to the device disclosed in Patent Document 2, on the basis of a first oscillator generated by determining the motion of the user, a second oscillator is generated to match the motion rhythm of the user to the desired motion rhythm. On the basis of the generated second oscillator, a model containing elastic elements such as a virtual spring or the like is used to generate an auxiliary oscillator and to apply to the user a torque according to the auxiliary oscillator to perform the control so as to prevent the motion scale of the user from deviating from the desired motion scale.

Meanwhile, it is desirable for the walk assist device to assist a user in walking by maintaining a balance between a motion rhythm and a motion scale of the user. In particular, when a user is performing a walk motion for the purpose of training, it is desirable to walk in such a way that an index value denoting the balance between the motion rhythm and the motion scale of the user, such as a walk ratio, approximates to a predefined reference value.

The device according to Patent Document 2 is configured to perform controls so as to keep the motion rhythm consistent with the desired motion rhythm and the motion scale consistent with the desired motion scale, however, the balance between the motion rhythm and the motion scale has not been taken into consideration. Therefore, it is possible that the balance may not be maintained between the motion rhythm and the motion scale due to the affection from the elastic element model.

SUMMARY OF THE INVENTION

The present invention has been accomplished in view of the aforementioned problems, and it is therefore an object of the present invention to provide a motion assist device capable of assisting a motion of a user so as to match a motion rhythm and a motion scale of the user to a desired motion rhythm and a desired motion scale thereof respectively and to maintain a balance between the motion rhythm and the motion scale of the user.

A first aspect of a motion assist device of the present invention is configured to assist a motion of a user according to an auxiliary oscillator, and comprises: a motion oscillator determination element configured to determine a first and a second motion oscillators serving as parameters which vary temporally according to physical motions of the user, and a third motion oscillator serving as a parameter which varies temporally according to physical motions of the user and denotes a motion scale of the user; a first oscillator generation element configured to generate a first oscillator as an output oscillation signal from a first model, which generates the output oscillation signal varying at a specific angular velocity defined on the basis of a first intrinsic angular velocity by entraining to an input oscillation signal, by inputting the first motion oscillator determined by the motion oscillator determination element as the input oscillation signal to the first model; an intrinsic angular velocity setting element configured to set an angular velocity of a second virtual oscillator as a second intrinsic angular velocity on the basis of a virtual model denoting a first virtual oscillator and a second virtual oscillator which interact with each other and vary periodically with a second phase difference and a first phase difference between the first motion oscillator determined by the motion oscillator determination element and the first oscillator generated by the first oscillator generation element so as to approximate the second phase difference to a desired phase difference; a second oscillator generation element configured to generate a second oscillator as an output oscillation signal from a second model, which generates the output oscillation signal varying temporally at a specific angular velocity defined on the basis of the second intrinsic angular velocity set by the intrinsic angular velocity setting element according to an input oscillation signal, by inputting the second motion oscillator determined by the motion oscillator determination element as the input oscillation signal to the second model; an auxiliary oscillator generation element configured to generate, on the basis of the second oscillator generated by the second oscillator generation element and the second intrinsic angular velocity set by the intrinsic angular velocity setting element, the auxiliary oscillator which includes therein a first auxiliary oscillator denoting an elastic force originated from a virtual elastic element for assisting the motion of the user so as to approximate a value of the third motion oscillator determined by the motion oscillator determination element to a desired value related to a desired motion scale of the user; a motion index value acquiring element configured to acquire a motion index value related to a balance between a motion rhythm and a motion scale of the user; and an auxiliary oscillator regulation element configured to sequentially regulate the first auxiliary oscillator generated by the auxiliary oscillator generation element so as to approximate the motion index value acquired by the motion index value acquiring element to a reference value.

According to the motion assist device of the first aspect of the present invention, the motion of the user can be assisted with the motion rhythm of the user matched to the desired motion rhythm mainly on the following reasons.

Specifically, by inputting the first motion oscillator as an input oscillation signal into the first model, the first oscillator is generated as an output oscillation signal from the first model. The first model refers to a model which generates an output oscillation signal varying temporally at a specific angular velocity defined according to an intrinsic angular velocity by entraining to an input oscillation signal (synchronization phenomenon). According to the entrainment to the first motion oscillator, the first oscillator oscillates with an autonomous rhythm or angular velocity defined according to the intrinsic angular velocity while harmonizing with the rhythm of the first motion oscillator of the user. It is acceptable to use a temporal differentiation of the second motion oscillator, which will be described hereinafter, as the first motion oscillator. In the present invention, "oscillation" is a concept including not only a real or virtual object swings at a substantially specific period but also varies temporally. "Oscillator" is referred to as a concept including an electric signal whose value varies temporally, and a function defined as a soft-ware whose value varies temporally and the like. However, from the viewpoint of matching the motion rhythm of the user to the desired motion rhythm thereof while harmonizing the motion rhythm of the user with the guiding rhythm of the motion assist device, the first oscillator may have an inappropriate phase difference from the motion oscillator of the user. Thereby, if the auxiliary oscillator is directly generated from the first oscillator, the motion rhythm of the user assisted by the auxiliary oscillator may deviate from the desired motion rhythm.

In this regard, on the basis of the first phase difference between the first motion oscillator and the first oscillator, the angular velocity of the second virtual oscillator is set as the second intrinsic angular velocity according to the virtual model denoted by the first virtual oscillator and the second virtual oscillator which vary periodically with the second phase difference while interacting with each other so as to approximate the second phase difference to the desired phase difference. Thus, the second intrinsic angular velocity is equivalent to the angular velocity of an appropriate oscillator from the viewpoint of assisting the user in motion by matching the motion rhythm of the user to the desired motion rhythm thereof while maintaining the harmonization according to the desired phase difference from the motion rhythm of the user defined by the first motion oscillator. As a result thereof, even if the motion rhythm of the user is varied abruptly, the compliance of the auxiliary oscillator to the variation can be appropriate from the viewpoint of applying no uncomfortable feeling to the user and the motion rhythm of the user can be made to approximate to the desired motion rhythm at an appropriate pace gradually.

Thereafter, the second motion oscillator is input to the second model as the input oscillation signal, and the second oscillator is generated as the output oscillation signal from the second model. The second model is a model which generates, on the basis of the input oscillation signal, an output oscillation signal varying temporally at a specific angular velocity defined according to a second intrinsic angular velocity. Thus, the second oscillator varying temporally at a specific angular velocity defined according to the second intrinsic angular velocity is generated. Thereafter, the auxiliary oscillator is generated on the basis of the second oscillator. Thereby, the motion rhythm of the user can be made to match with the desired motion rhythm thereof while maintaining the harmonization between the motion rhythm of the user assisted by the auxiliary oscillator and the rhythm of the auxiliary oscillator. According to the harmonization between the motion rhythm of the user and the rhythm of the auxiliary oscillator, the guiding rhythm of the motion assist device can be harmonized to the motion rhythm of the user and the motion rhythm of the user can be harmonized to the guiding rhythm of the motion assist device as mentioned above, the harmonization (mutual concession) between the user (human) and the device (machine) can be achieved.

According to the motion assist device of the first aspect of the present invention, the motion of the user can be assisted with the motion scale of the user matched to the desired motion scale mainly on the following reasons.

The auxiliary oscillator which includes the first auxiliary oscillator denoting an elastic force originated from a virtual elastic element for assisting the motion of the user so as to approximate the third motion oscillator related to the motion scale of the user to the desired value thereof is generated. It is acceptable to determine the second motion oscillator as the third motion oscillator. The elastic force of the virtual elastic element is in relation to a new intrinsic angular velocity corresponding to the angular velocity of an appropriate oscillator from the viewpoint of assisting the user in motion so as to match the motion rhythm of the user to the desired motion rhythm thereof while maintaining the harmonization with the motion rhythm of the user. Therefore, by assisting the motion of the user according to the auxiliary oscillator including therein the first auxiliary oscillator, the motion of the user can be assisted to approximate the value of the third motion oscillator related to the motion scale of the user to the desired value, in other words, to approximate the motion scale of the user to the desired motion scale thereof while maintaining the harmonization between the motion rhythm of the user and the rhythm of the auxiliary oscillator and the match between motion rhythm of the user and the desired motion rhythm thereof.

According to the motion assist device of the first aspect of the present invention, the motion index value (for example, a walk ratio, a footstep or the like) related to a balance between the motion rhythm and the motion scale of the user is acquired through the motion index value acquiring element. Thereafter, the first auxiliary oscillator is sequentially regulated by the auxiliary oscillator regulation element so as to approximate the motion index value of the user to the reference value. In other words, with respect to the second oscillator generated for matching the motion rhythm of the user to the desired motion rhythm thereof, the elastic force originated from the virtual elastic element for assisting the motion of the user to match the motion scale of the user to the desired motion scale thereof is sequentially regulated so as to approximate the motion index value related to a balance between the motion rhythm and the motion scale of the user to the reference value. Thereby, through regulating the first auxiliary oscillator to approximate the motion index value of the user to the reference value, the balance between the rhythm and the scale of the generated auxiliary oscillator is regulated, and consequently, the motion of the user assisted by the auxiliary oscillator can be performed with an appropriate balance.

As above-mentioned, according to the motion assist device of the present invention, the motion of the user can be assisted so as to match the motion rhythm and the motion scale of the user to the desired motion rhythm and the desired motion scale thereof respectively and to maintain a balance between the motion rhythm and the motion scale of the user.

As the motion index value related to the balance between the motion rhythm and the motion scale of the user, it is acceptable to use a value (for example, the walk ratio or the like) which directly denotes the balance between the motion rhythm and the motion scale of the user. For example, the first auxiliary oscillator may be regulated to approximate the walk ratio determined from the motion performed by the user to a standard walk ratio. Further, as the motion index value related to the balance between the motion rhythm and the motion scale of the user, it is acceptable to use a value (for example, the footstep or the like) which is related to a value (for example, the walk ratio or the like) directly denoting the balance between the motion rhythm and the motion scale of the user. For example, the first auxiliary oscillator may be regulated to approximate the footstep determined from the motion performed by the user to a standard footstep derived from the standard walk ratio.

The motion of the user includes various motions such as walk, run, and manufacturing operations by hand. For example, when hand operations related to the manufacture of products such as vehicles or the like are assisted, the user can work with desired motion rhythm and magnitude (or strength of force) by following the auxiliary oscillator. If the desired motion rhythm and scale are set according to the hand operations of a skilled worker, the user can sense in person the subtle hand motions or strength of force of the skilled worker, and therefore, the user can master the same skill earlier.

A second aspect of the motion assist device of the present invention is dependent on the first aspect of the present invention, wherein the auxiliary oscillator generation element generates the first auxiliary oscillator including therein an oscillator which is calculated as a product of a first coefficient, a third coefficient and the second oscillator; the first coefficient serves as the elastic coefficient of the virtual elastic element and is a function of a first parameter and the second intrinsic angular velocity set by the intrinsic angular velocity setting element; the third coefficient is a function of a third parameter and a deviation of the value of the third motion oscillator from the desired value; and the auxiliary oscillator regulation element, on the basis of a deviation of the motion index value from the reference value of the motion index value, sequentially regulates at least one of the first parameter for calculating the first coefficient and the third parameter for calculating the third coefficient so as to approximate the motion index value to the reference value.

According to the motion assist device of the second aspect of the present invention, the first auxiliary oscillator is denoted as the first coefficient serving as the elastic coefficient (spring coefficient) and the elastic force from the elastic element (the third coefficient) such as a virtual spring which restores the value of the third motion oscillator (for example, a hip joint angle) related to the motion scale of the user to the desired value (for example, a desired hip joint angle). Thus, the motion of the user can be assisted with the motion rhythm and motion scale reflecting the elastic element of the user's body, such as the elastic force or the like generated from the contracted state of a muscle to the relaxed state thereof. According to the present invention, at least one of the first parameter for calculating the first coefficient and the third parameter for calculating the third coefficient is sequentially regulated by the auxiliary oscillator regulation element so as to approximate the motion index value to the reference value. Thereby, the regulation for approximating the motion index value to the reference value is sequentially applied to the elastic force generated from the virtual elastic element for assisting the motion of the user.

If the first parameter and the third parameter are included in a parameter set composed of a plurality of parameters, each parameter in the parameter set can be regulated sequentially.

A third aspect of the motion assist device of the present invention is dependent on the first aspect of the present invention, further includes a setting element for setting the reference value of the motion index value according to an operation from the user or a motion state of the user.

According to the motion assist device of the third aspect of the present invention, the reference value (for example, a reference value for the walk ratio or the like) of the motion index value for the training of the walk motion or the like, for example, can be easily designated by the user or can be selectively set by the user according to the motion state of the user.

A fourth aspect of the motion assist device of the present invention is dependent on the first aspect of the present invention, further includes a setting element for setting the desired value related to the desired motion scale of the user according to the reference value of the motion index value.

According to the motion assist device of the fourth aspect of the present invention, the first auxiliary oscillator denoting the elastic force originated from the virtual elastic element for assisting the motion of the user is generated so as to approximate the value of the third motion oscillator to the desired value based on the reference value of the motion index value of the user. Accordingly, the motion index value of the user is approximated to the reference value, and the motion can be assisted to maintain the balance between the motion rhythm and the motion scale of the user.

A fifth aspect of the motion assist device of the present invention is dependent on the first aspect of the present invention, wherein the motion of the user is performed at a left side and a right side of the user, respectively; and the auxiliary oscillator regulation element sequentially regulates the first auxiliary oscillator so as to approximate the motion index value of the user to the reference value for the motion performed respectively at the left side and the motion performed at the right side.

According to the motion assist device of the fifth aspect of the present invention, when the motion of the user is performed respectively at the left side and the right side of the user, like a walk motion, for example, the first auxiliary oscillator can be regulated independently for the motion performed respectively at the left side and the motion performed at the right side. Thereby, the elastic force originated from the virtual elastic element for assisting the motion of the user can be finely and sequentially regulated so as to approximate the motion index value of the user to the reference value.

A sixth aspect of the motion assist device of the present invention is dependent on the first aspect of the present invention, wherein the motion of the user is composed of a motion in a flexion direction and a motion in a stretch direction; and the auxiliary oscillator regulation element sequentially regulates the first auxiliary oscillator so as to approximate the motion index value of the user to the reference value for the motion in the flexion direction and the motion in the stretch direction of the user, respectively.

According to the motion assist device of the sixth aspect of the present invention, when the motion of the user is composed of the motion in the flexion direction and the motion in the stretch direction, like the walk motion, for example, the first auxiliary oscillator may be regulated independently with respect to the motion in the flexion direction and the motion in the stretch direction of the user, respectively. Thereby, the elastic force originated from the virtual elastic element for assisting the motion of the user can be sequentially regulated more finely so as to approximate the motion index value of the user to the reference value.

DETAILED DESCRIPTION OF THE PREFERRED EMBODIMENTS

An embodiment regarding a motion assist device of the present invention will be described with reference to the drawings. Hereinafter, subscripts "L" and "R" are added to a parameter to differentiate a left side and a right side of legs or the like. If there is not necessary to differentiate the left side and the right side or a vector has both of the left and right components, the subscripts are omitted.

Figure 1:
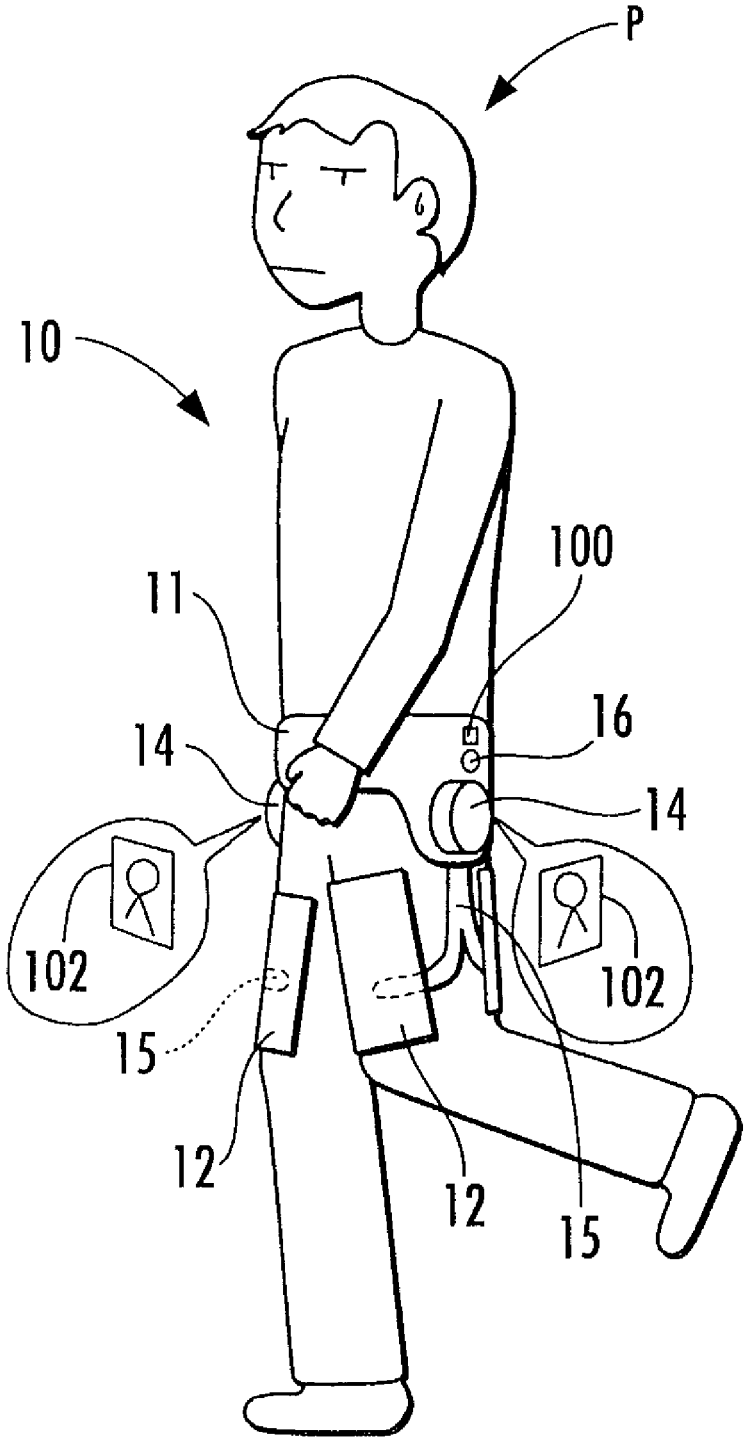
FIG. 1 is an external view of a motion assist device of the present invention.

A walk assist device (an example of the mot ion assist device) 10 illustrated in FIG. 1 includes a first orthosis 11, a pair of laterally disposed second orthoses 12, a pair of laterally disposed actuators 14, a battery 16, a first controller 100, and a hip joint angle sensor 102.

The first orthosis 11 and the second orthoses 12 are both made from a combination of rigid materials and flexible materials such as fibers. The first orthosis 11 is mounted at a back side of the waist or a lower portion of the body (first body portion) of a human (user) P. The second orthoses 12 are mounted on a front side and a back side of the thigh or an upper portion of the leg (second body portion), respectively, of the human P. The second orthoses 12 are not limited to be disposed at both sides of the left and right second body portions, respectively. It is acceptable to dispose the second orthoses 12 only at one side thereof.

The actuator 14 is composed of a motor. It may be composed of either one or both of a reduction gear and a compliance mechanism in addition to the motor if necessary. The actuators 14 are disposed laterally at both side of the waist to have a connection with the first orthosis 11 when the first orthosis 11 has been mounted around the waist. The actuators 14 are connected via a connection member 15 to the second orthoses 12 mounted respectively at the front side and the back side of the thigh. The connection member 15 is made of materials of shaping property, such as hard plastics of light weight or the like. After the first orthosis 11 has been mounted around the waist and the second orthoses 12 have been mounted at the thigh, the connection member 15 is configured to extend from the lateral side of the waist along the lateral outside of the thigh downward and split into two branches extending to the front side and the back side of the thigh, respectively. According thereto, when the actuator 14 operates, it applies a force to both the waist and the thigh to assist the relative motions of the waist and the thigh. The relative motions of the waist and the thigh include anteroposterior motion of the thigh of a leg leaving the ground with respect to the waist and anteroposterior motion of the waist with respect to a leg stepping on the ground.

The battery 16 is housed in the first orthosis 11 (for example, fixed between plural plates of elements constituting the first orthosis 11). The battery 16 supplies electric power to the actuators 14, the first controller 100 and the like.

The hip joint angle sensor 102 is composed of a rotary encoder disposed on a transverse side of the waist of the human P and outputs a signal in relation to the hip joint angle.

Note that the first controller 100 and the battery 16 may be housed not only in the first orthosis 11 but also in the second orthosis 12, respectively; it is also acceptable to dispose them separately from the first orthosis 11 and the second orthosis 12.

The first controller 100 includes a computer (composed of a CPU, a ROM, a RAM, a signal input circuit, a signal output circuit and the like) housed in the first orthosis 11 and a software stored in a memory or a storing device in the computer. The first controller 100 performs various functions by executing the software in the computer.

The first controller 100 controls an operation or an output (torque) of the actuator 14 by adjusting an electrical power supplied from the battery 16 to the actuator 14.

Figure 2:
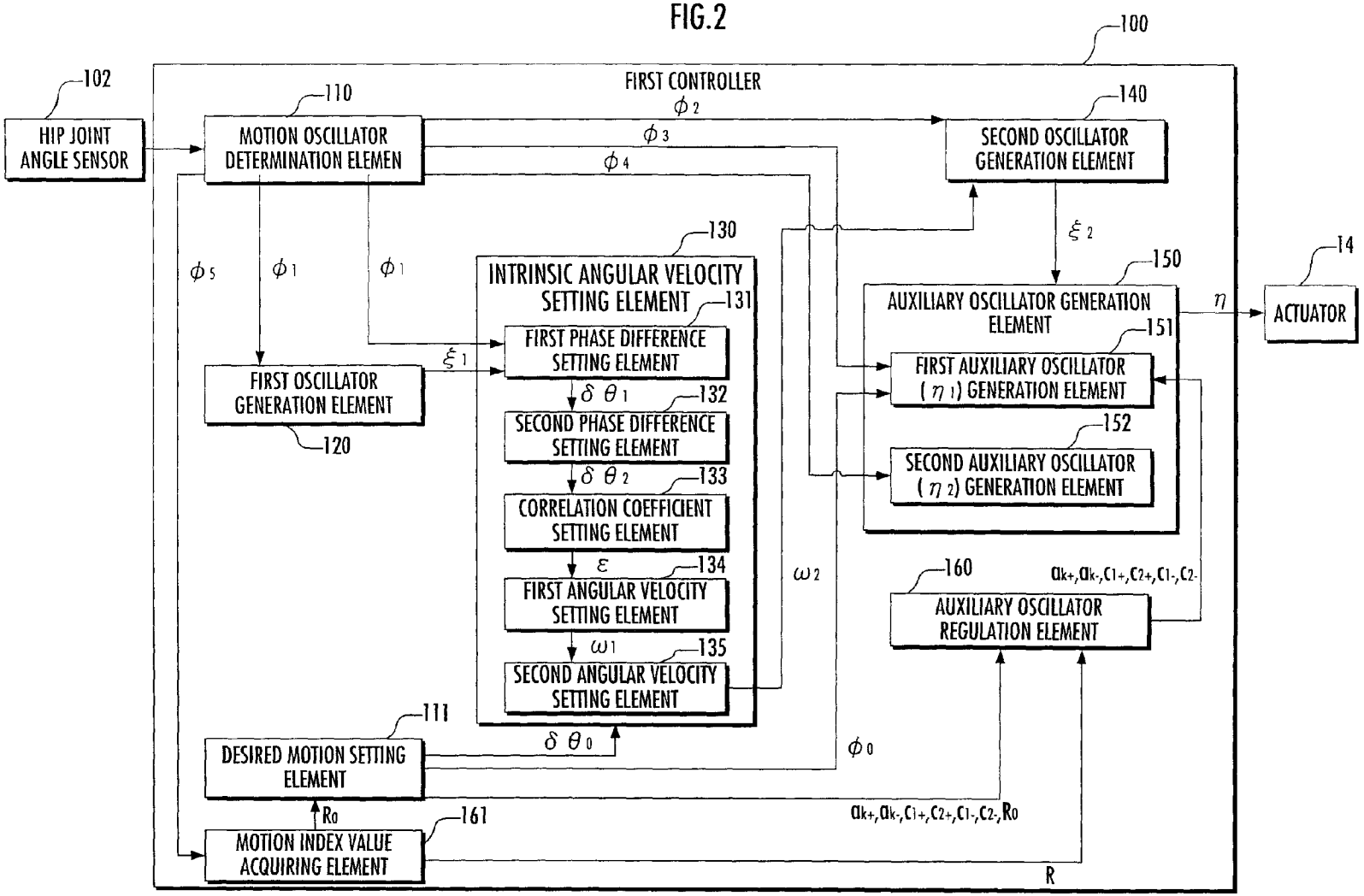
FIG. 2 is a functional block view of a control system of the motion assist device in FIG. 1.

As illustrated in FIG. 2, the first controller 100 is provided with a motion oscillator determination element 110, a first oscillator generation element 120, an intrinsic angular velocity setting element 130, a second oscillator generation element 140, an auxiliary oscillator generation element 150, a desired motion setting element 111, an auxiliary oscillator regulation element 160, and a motion index value acquiring element 161. Each element may be composed of a mutually different CPU or the like, or a universal CPU or the like.

The motion oscillator determination element 110, on the basis of the output from the hip joint angle sensor 102, determines an angular velocity of each hip joint as a first motion oscillator $\phi_1$ and an angle of each hip joint as a second motion oscillator $\phi_2$ for the left and right hip joints. The first motion oscillator $\phi_1$ and the second motion oscillator $\phi_2$ are equivalent to parameters periodically varying in accordance with the periodical motion of the human P. Determination of the motion oscillator refers to the determination of a periodically varying pattern of the parameters. "Periodical" means that a magnitude, phase, and an angular velocity which is a first order temporal differentiation of phase can be defined. It does not mean that the magnitude or the phase is fixed.

It is acceptable to determine an arbitrary combination of different parameters periodically varying in relation to the periodical motion of the human P with an appropriate sensor as a combination of the first motion oscillator $\phi_1$ and the second motion oscillator $\phi_2$. Parameters periodically varying at a rhythm (defined by the period or an angular velocity in proportion to the reciprocal thereof) denoting the periodical motion of an identical portion may be determined as the first motion oscillator $\phi_1$ and the second motion oscillator $\phi_2(=d^n\phi_1/dt^n(n=1, 2, \ldots))$, respectively. For example, on one hand, parameters may be determined as an angle of an arbitrary joint, such as the hip joint, knee joint, ankle joint, shoulder joint, elbow joint and the like, and the position of the thigh, foot, upper arm, hand and waist (the position or the like in the anteroposterior direction or the vertical direction with the center-of-gravity of the human P as a reference) may be determined as one motion oscillator of the first motion oscillator $\phi_1$ and the second motion oscillator $\phi_2$; on the other hand, a temporal integration of an angular velocity or an angular acceleration of an identical joint, or an transition velocity or acceleration in the anteroposterior direction of the same joint, may be determined as the other motion oscillator thereof.

Moreover, parameters periodically varying at a rhythm denoting the periodical motions of different portions may be determined as the first motion oscillator $\phi_1$ and the second motion oscillator $\phi_2$, respectively. For example, on one hand, parameters may be determined as an angle of a first joint or a position of a first portion may be determined as one motion oscillator of the first motion oscillator $\phi_1$ and the second motion oscillator $\phi_2$; on the other hand, a temporal integration of an angular velocity or angular acceleration of a second joint different from the first joint, or a velocity or acceleration of a second portion different from the first portion, may be determined as the other motion oscillator.

Furthermore, parameters varying at a rhythm in conjunction with the walk motion rhythm, such as a sound generated when the left or right foot steps on ground, breathing sound, deliberate phonation or the like, may be determined as either one or both of the first motion oscillator $\phi_1$ and the second motion oscillator $\phi_2$.

As to be described hereinafter, the first motion oscillator $\phi_1$ is equivalent to a fourth motion oscillator $\phi_4$ denoting a motion velocity (motion rhythm) of the human P, and the second motion oscillator $\phi_2$ is equivalent to a third motion oscillator $\phi_3$ denoting a motion magnitude (motion scale) of the human P. An auxiliary oscillator $\eta$ is generated on the basis of the third motion oscillator $\phi_3$ and the fourth motion oscillator $\phi_4$. The motion magnitude of a portion of the human P which is actually assisted (a portion where an assisting force is applied) by the motion assist device 10 is determined as the third motion oscillator $\phi_3$. It is acceptable to determine a parameter varying periodically different from the first motion oscillator $\phi_1$ as the fourth motion oscillator $\phi_4$ and a parameter varying periodically different from the second motion oscillator $\phi_2$ as the third motion oscillator $\phi_3$.

As to be described hereinafter, each of the third motion oscillator $\phi_3$ and the fourth motion oscillator $\phi_4$ is equivalent to a fifth motion oscillator $\phi_5$ used for calculating a motion index value (walk ratio) R which denotes a balance between the motion rhythm and the motion scale of the human P. On the basis of the fifth motion oscillator $\phi_5$, a first auxiliary oscillator $\eta_1$ is regulated. It is acceptable to determine a parameter varying periodically different from the third motion oscillator $\phi_3$ and the fourth motion oscillator $\phi_4$ as the fifth motion oscillator $\phi_5$.

The desired motion setting element 111 sets values related to a desired motion rhythm and a desired motion scale for the human P. Specifically, the desired motion setting element 111 sets coefficients related to the desired motion rhythm and the desired motion scale, a desired phase difference $\delta\theta_0$, a desired value in accordance with the desired motion scale of the human P (a desired hip joint angle $\phi_0$ in the present embodiment), and a reference value of the motion index value of the human P (a standard walk ratio $R_0$ in the present embodiment). The desired phase difference $\delta\theta_0$ is used by the intrinsic angular velocity setting element 130. The coefficients, the desired value $\phi_0$ and the reference value $R_0$ of the human P are used by the auxiliary oscillator generation element 150 and the auxiliary oscillator regulation element 160.

The first oscillator generation element 120 generates a first oscillator $\xi_1$ as an output oscillation signal by inputting the first motion oscillator $\phi_1$ determined by the motion oscillator determination element 110 as an input oscillator signal to a first model. The generation of an oscillator refers to the definition of a periodically varying pattern of the parameters. The "first model" is a model which generates the output oscillation signal varying at a specific angular velocity defined according to a first intrinsic angular velocity $\omega_1$ by entraining to the input oscillation signal. It is also acceptable that the first oscillation generation element 120 sequentially updates the first model by adopting a new second intrinsic angular velocity $\omega_2$ set by the intrinsic angular velocity setting element 130 as a new first intrinsic angular velocity $\omega_1$, and generates a subsequent first oscillator $\xi_1$ as the output oscillation signal by inputting a subsequent first motion oscillator $\phi_1$ as the input oscillation signal into the updated first model.

The intrinsic angular velocity setting element 130, on the basis of a first phase difference $\delta\theta_1$, sets a second intrinsic angular velocity $\omega_2$ according to a virtual model so as to approximate a second phase difference $\delta\theta_2$ to the desired phase difference $\delta\theta_0$. The first phase difference $\delta\theta_1$ is the phase difference between the first motion oscillator $\phi_1$ determined by the motion oscillator determination element 110 and the first oscillator $\xi_1$ generated by the first oscillator generation element 120. The virtual model is a model in which the first motion oscillator $\phi_1$ (broadly referring to the parameters periodically varying in relation to the motion of the human P) is denoted as a first virtual oscillator $\phi_1$, the auxiliary oscillator $\eta$ (or the first oscillator $\xi_1$) periodically varying in relation to the operations of the motion assist device 10 is denoted as a second virtual oscillator $\phi_2$, and the phase difference between the first motion oscillator $\phi_1$ and the auxiliary oscillator $\eta$ is denoted as a second phase difference $\delta\theta_2$ which is the phase difference between the first virtual oscillator $\phi_1$ and the second virtual oscillator $\phi_2$.

The intrinsic angular velocity setting element 130 includes a first phase difference setting element 131, a second phase difference setting element 132, a correlation coefficient setting element 133, a first angular velocity setting element 134, and a second angular velocity setting element 135. The first phase difference setting element 131 sets the phase difference between the first motion oscillator $\phi_1$ and the first oscillator $\xi_1$ as the first phase difference $\delta\theta_1$. The second phase difference setting element 132 sets the phase difference between the first virtual oscillator $\phi_1$ and the second virtual oscillator $\phi_2$ as the second phase difference $\delta\theta_2$. The correlation coefficient setting element 133 sets a correlation coefficient between the first virtual oscillator $\phi_1$ and the second virtual oscillator $\phi_2$ so as to approximate the second phase difference $\delta\theta_2$ set by the second phase difference setting element 132 to the first phase difference $\delta\theta_1$ set by the first phase difference setting element 131. The first angular velocity setting element 134 sets an angular velocity $\omega_{1/}$ of the first virtual oscillator $\phi_1$ on the basis of the correlation coefficient $\epsilon$ set by the correlation coefficient setting element 133.

The second angular velocity setting element 135 sets an angular velocity $\omega_{2/}$ of the second virtual oscillator $\phi_2$ on the basis of the angular velocity $\omega_{1/}$ of the first virtual oscillator $\phi_1$ set by the first angular velocity setting element 134 so as to approximate the second phase difference $\delta\theta_2$ set by the second phase difference setting element 132 to the desired phase difference $\delta\theta_0$. The intrinsic angular velocity setting element 130 sets the angular velocity $\omega_{2/}$ of the second virtual oscillator $\phi_2$ as the second intrinsic angular velocity $\omega_2$.

The second oscillator generation element 140 generates a second oscillator $\xi_2$ as an output oscillation signal by inputting the second motion oscillator $\phi_2$ determined by the motion oscillator determination element 110 as an input oscillator signal to a second model. The "second model" is a model which generates the output oscillation signal varying at a specific angular velocity defined according to a second intrinsic angular velocity $\omega_2$ on the basis of the input oscillation signal.

The auxiliary oscillator generation element 150 generates the auxiliary oscillator $\eta$ for defining the torque applied from the actuator 14 of the motion assist device 10 to the thigh p on the basis of the second oscillator $\xi_2$ generated by the second oscillator generation element 140.

The auxiliary oscillator generation element 150 is provided with a first auxiliary oscillator generation element 151, a second auxiliary oscillator generation element 152, and an auxiliary oscillator regulation element.

The motion index value acquiring element 161, on the basis of the fifth motion oscillator $\phi_5$ determined by the motion oscillator determination element 110, acquires the motion index value of the user denoting a balance between the motion rhythm and the motion scale of the human P. In the present embodiment, the walk ratio R (=footstep W/walk frequency U) is acquired as the motion index value related to the balance the motion rhythm and the motion scale of the human P on the basis of the hip joint angular velocity and the hip joint angle. It is acceptable to use the footstep W as a value related to the walk ratio R denoting the balance the motion rhythm and the motion scale of the human P as the motion index value. It is also acceptable to use the footstep or the hip joint angle set separately in the flexion direction and the stretch direction in place of the footstep W as the motion index value.

The auxiliary oscillator regulation element 160 regulates a coefficient set by the desired motion setting element 111. As to be described hereinafter, the coefficient is used by the auxiliary oscillator generation element 150 to generate the first auxiliary oscillator $\eta_1$. The auxiliary oscillator regulation element 160 regulates the coefficient on the basis of a deviation of the motion index value (the walk ratio) R acquired by the motion index value acquiring element 161 from the reference value (the standard walk ratio) $R_0$ of the motion index value set by the desired motion setting element 111.

The auxiliary oscillator generation element 150, on the basis of the second oscillator $\xi_2$ generated by the second oscillator generation element 140, generates the auxiliary oscillator $\eta$ for defining the torque applied from the actuator 14 of the motion assist device 10 to the thigh p. Specifically, the auxiliary oscillator generation element 150, on the basis of the second oscillator U, generates the first auxiliary oscillator $\eta_1$ by using the second intrinsic angular velocity $\omega_2$ set by the intrinsic angular velocity setting element 130, the third motion oscillator $\phi_3$ determined by the motion oscillator determination element 110, and the coefficient regulated by the auxiliary oscillator regulation element 160. Moreover, the auxiliary oscillator generation element 150, on the basis of the second oscillator U, generates the second auxiliary oscillator $\eta_2$ by using the second intrinsic angular velocity $\omega_2$ set by the intrinsic angular velocity setting element 130, the third motion oscillator $\phi_3$ and the fourth motion oscillator $\phi_4$ determined by the motion oscillator determination element 110, and the coefficient set by the desired motion setting element 111. Thereby, the auxiliary oscillator generation element 150 generates the auxiliary oscillator $\eta$ including the first auxiliary oscillator $\eta_1$ and the second auxiliary oscillator $\eta_2$.

The walk motion of the human P is assisted by the walk assist device 10 with the configuration mentioned above. The assist method thereof will be described with reference to the drawings from FIG. 2 to FIG. 4.

Figure 3:
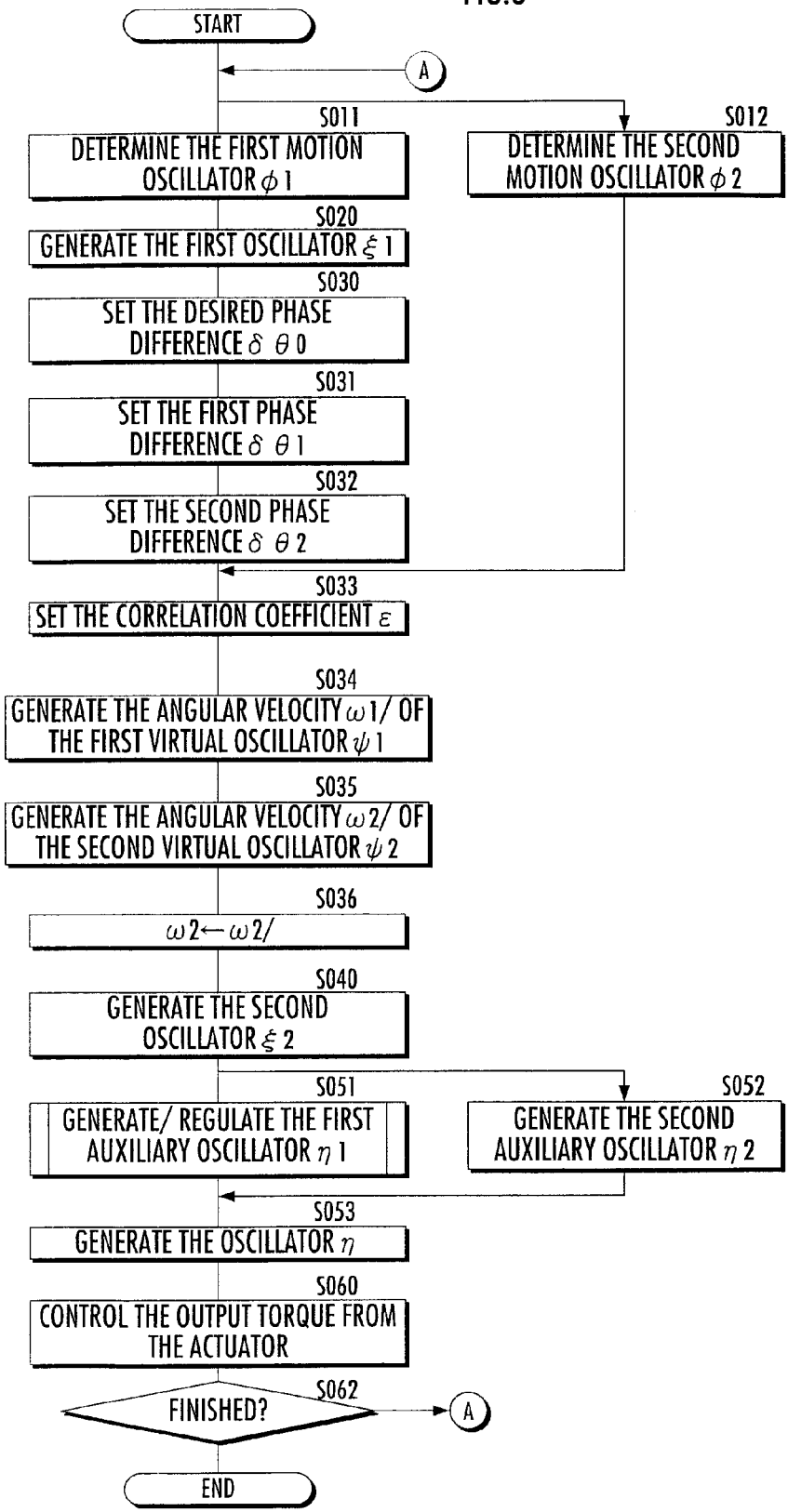
FIG. 3 is a flow chart illustrating an overall operation of the motion assist device in FIG. 1.

The operation of the walk assist device 10 controlled by the first controller 100 will be described as the following. First, when the human P starts the walk motion, the motion oscillator determination element 110, on the basis of the output from the hip joint angle sensor 102, determines the left hip joint angular velocity and the right hip joint angular velocity of the human P as the first motion oscillator $\phi_1=(\phi_{1L}, \phi_{1R})$ and the fourth motion oscillator $\phi_4=(\phi_{4L}, \phi_{4R})$, respectively (FIG. 3/S011). Thereafter, the motion oscillator determination element 110, on the basis of the output from the hip joint angle sensor 102, determines the left hip joint angle and the right hip joint angle of the human P as the second motion oscillator $\phi_2=(\phi_{2L}, \phi_{2R})$ and the third motion oscillator $\phi_3=(\phi_{3L}, \phi_{3R})$, respectively (FIG. 3/S012).

Thereafter, the first oscillator generation element 120 generates the first oscillator $\xi_1$ as the output oscillation signal by inputting the first motion oscillator $\phi_1$ determined by the motion oscillator determination element 110 as the input oscillation signal into the first model (FIG. 3/S020). The first model denotes the correlation between a plurality of the first elements such as the left and right feet or the like, and generates the output oscillation signal which varies at the angular velocity defined according to the first intrinsic angular velocity $\omega_1=(\omega_{1L}, \omega_{1R})$ by entraining to the input oscillation signal as described above. The first model, for example, may be defined by the Van der Pol equation expressed by the equation (10).

$$(d^2\phi_{1L}/dt^2)=A(1-\xi_{1L}^2)(d\xi_{1L}/dt)-\omega_{1L}^2\xi_{1L}+g(\xi_{1L}-\tau_{1R})+K_1\phi_{1L},$$

$$(d^2\phi_{1R}/dt^2)=A(1-\xi_{1R}^2)(d\xi_{1R}/dt)-\omega_{1R}^2\xi_{1R}+g(\xi_{1R}-\xi_{1L})+K_1\phi_{1R} \quad (10)$$

Wherein:

A: a positive coefficient set in such a way that a stable limit cycle may be drawn from the first oscillator $\xi_1$ and the first order temporal differentiation value ($d\xi_1/dt$) thereof in a plane of "$\xi_1-(d\xi_1/dt)$";

g: a first correlation coefficient for reflecting the correlation of different body parts such as the left and right feet of the human P or the like as a correlation (correlation between the output oscillation signals from the plurality of the first elements) of each of the left and right components of the first oscillator $\xi_1$; and $K_1$: a feedback coefficient related to the first motion oscillator $\phi_1$.

The first oscillator $\xi_1=(\xi_{1L}, \xi_{1R})$ is calculated or generated according to the Runge-Kutta method. The respective angular velocity of the components $\xi_{1L}$ and $\xi_{1R}$ of the first oscillator $\xi_1$ denotes a virtual rhythm which assists the respective motions of the left foot and the right foot. Further, the first oscillator $\xi_1$ has the property to vary or oscillate periodically with an autonomous angular velocity or rhythm defined on the basis of the first intrinsic angular velocity $\omega_1$ while harmonizing with the rhythm of the first motion oscillator $\phi_1$ varying at an angular velocity or rhythm substantially the same as a rhythm of the actual walk motion, according to the "mutual entrainment" (harmonization effect) which is one of the properties of the Van del Pol equation.

In addition, the first model may be expressed by the Van der Pol equation in a form different from that of the equation (10), or by a certain equation which generates the output oscillation signal varying periodically at the angular velocity defined on the basis of the first intrinsic angular velocity $\omega_1$, accompanied by the mutual entrainment to the input oscillation signal. Moreover, it is acceptable to increase the numbers of the first motion oscillator $\phi_1$, namely the determination object. The more numbers of the first motion oscillators $\phi_1$ are input to the first model, the motions of various body parts of the human P will be more elaborately assisted through regulating the correlation coefficients, although the correlation members in a non-linear differentiation equation corresponding to the generation of the first oscillator $\xi_1$ in the Van der Pol equation for defining the first model will become more accordingly.

Subsequently, the desired motion setting element 111 sets the desired phase difference $\delta\theta_0=(\theta_{0L}, \theta_{0R})$ as the value related to the desired motion rhythm and motion scale of the human P (FIG. 3/S030). A predefined value may be used as the desire phase difference $\delta\theta_0$. Thus, it is acceptable for the desired motion setting element 111 to set a value input by the human P through setting buttons (now shown) disposed in the walk assist device 10 as the desired phase difference $\delta\theta_0$, and it is also acceptable for the desired motion setting element 111 to determine a walk state of the human P according to at least one motion oscillator determined by the motion oscillator determination element 110 and set the desired phase difference $\delta\theta_0$ by selecting one value from a plurality of values predefined on the basis of the determined walk state. Specifically, the desired motion setting element 111 retrieves a predefined correlation between the walk state and a trajectory pattern drawn in an n-dimension space defined by n (n=1, 2, . . . ) motion oscillators containing the hip joint angular velocity $\phi_4$ from memory. Then, the desired motion setting element 111 determines the walk state according to the retrieved correlation and the trajectory pattern drawn in the n-dimension space defined by the determined n motion oscillators.

The walk state of the human P includes a flat walk in which the human P walks on a substantially flat ground, an ascending walk state in which the human P walks up a slope or walks upstairs, a descending walk state in which the human P walks down the slope or walks downstairs, a slow walk state in which the human P walks without haste, and a quick walk state in which the human P walks in a hurry.

As the motion oscillators for determining the walk state, parameters varying at a rhythm related to the walk motion rhythm, such as the hip joint angle, the angle or angular velocity or angular acceleration of the knee joint, the ankle joint, the shoulder joint, the elbow joint, the position of a part of the legs of the human P, sounds generated when the left or the right foot steps on ground, breathing sounds, deliberate phonations or the like, may be determined.

Thereafter, the intrinsic angular velocity setting element 130, on the basis of the first motion oscillator $\phi_1$ determined by the motion oscillator determination element 110, the first oscillator $\xi_1$ generated by the first oscillator generation element 120, and the first phase difference $\delta\theta_1$ between the first motion oscillator $\phi_1$ and the first oscillator $\xi_1$, sets the second intrinsic angular velocity $\omega_2$ so as to approximate the second phase difference $\delta\theta_2$ to the desired phase difference $\delta\theta_0$.

Specifically, the first phase difference setting element 131 sets a phase difference between the first motion oscillator $\phi_1$ determined by the motion oscillator determination element 110 and the first oscillator $\xi_1$ generated by the first oscillator determination element 120 as the first phase difference $\delta\theta_1$ (FIG. 3/S031). For example, the first phase difference $\delta\theta_1$ is calculated or defines on the basis of a time difference between a time where $\phi_1=0$ and $(d\phi_1/dt)>0$ and another time where $\xi_1=0$ and $(d\xi_1/dt)>0$.

Thereafter, the second phase difference setting element 132 sets the second phase difference $\delta\theta_2$ on a condition that the first phase difference $\delta\theta_1$ over the recent three walk cycles is constant or the first phase difference $\delta\theta_1$ varies within an allowable range (FIG. 3/S032). In detail, a phase difference between the first virtual oscillator $\phi_1=(\phi_{1L}, \phi_{1R})$ and the second virtual oscillator $\phi_2=(\phi_{2L}, \phi_{2R})$ which are defined in the virtual model, which is expressed by the equations (21) and (22), are set as the second phase difference $\delta\theta_2$ according to the equation (23). The first virtual oscillator $\phi_1$ in the virtual model virtually denotes the first motion oscillator $\phi_1$; the second virtual oscillator $\phi_2$ in the virtual model virtually denotes the auxiliary oscillator $\eta$.

$$d\phi_{1L}/dt=\omega_{1L}+\epsilon_L \sin(\phi_{2L}-\phi_{1L}),\ d\phi_{1R}/dt=\omega_{1R}+\epsilon_R \sin(\phi_{2R}-\phi_{1R}) \tag{21}$$

$$d\phi_{2L}/dt=\omega_{2L}+\epsilon_L \sin(\phi_{1L}-\phi_{2L}),\ d\phi_{2R}/dt=\omega_{2R}+\epsilon_R \sin(\phi_{1R}-\phi_{2R}) \tag{22}$$

$$\delta\theta_{2L}=\arcsin\{(\omega_{1/L}-\omega_{2/L})/2\epsilon_L\},\ \delta\theta_{2R}=\arcsin\{(\omega_{1/R}-\omega_{2/R})/2\epsilon_R\} \tag{23}$$

Wherein, each component of "$\epsilon=(\epsilon_L, \epsilon_R)$" stands for a correlation coefficient denoting the correlation between each component of the first virtual oscillator $\phi_1$ and each component of the second virtual oscillator $\phi_2$. "$\omega_{1/}=(\omega_{1/L}, \omega_{1/R})$" is the angular velocity for each component of the first virtual oscillator $\phi_1$, and "$\omega_{2/}=(\omega_{2/L}, \omega_{2/R})$" is the angular velocity for each component of the second virtual oscillator $\phi_2$.

Subsequently, the correlation coefficient setting element 133 sets the correlation coefficient $\epsilon$ so that the deviation between the first phase difference $\delta\theta_1$ set by the first phase difference setting element 131 and the second phase difference $\delta\theta_2$ set by the second phase difference setting element 132 is minimum (FIG. 3/S033).

Specifically, the correlation coefficient $\epsilon(t_i)$ at each time $t_i$ where the first motion oscillator $\phi_1$ for each of the left and right components becomes zero is sequentially set according to the equation (24).

$$\epsilon_L(t_{i-1})=\epsilon_L(t_i)-B_L\{V_L(t_{i+1})-V_L(t_i)-\epsilon_L(t_{i-1})\},$$

$$\epsilon_R(t_{i+1})=\epsilon_R(t_i)-B_R\{V_R(t_{i+1})-V_R(t_i)\}/\{\epsilon_R(t_i)-\epsilon_R(t_{i-1})\},$$

$$V_L(t)=(1/2)\{\delta\theta_{1L}(t_{i+1})-\delta\theta_{2L}(t_i)\}^2,$$

$$V_R(t)=(1/2)\{\delta\theta_{1R}(t_{i+1})-\delta\theta_{2R}(t_i)\}^2 \tag{24}$$

Wherein, each component of "$B=(B_L, B_R)$" stands for a coefficient representing the stability of the potential $V=(V_L, V_R)$ for approximating each component of the first phase difference $\delta\theta_1$ to each of the left and right components of the second phase difference $\delta\theta_2$.

Next, the first angular velocity setting element 134, on the basis of the correlation coefficients set by the correlation coefficient setting element 133, sets the angular velocity $\omega_{1/}$ of the first virtual oscillator $\phi_1$ according to the equation (25) so that the deviation between the first phase difference $\delta\theta_1$ and the second phase difference $\delta\theta_2$ for each component is minimum at a condition that the angular velocity $\omega_{2/}$ of the first virtual oscillator $\phi_2$ is constant (FIG. 3/S034).

$$\omega_{1/L}(t_i)=-\alpha_L\int dt q_{1L}(t),\ \omega_{1/R}(t_i)=-\alpha_R\int dt q_{1R}(t)$$

$$q_{1L}(t)=(4\epsilon_L^2(t_i)-(\omega_{1L}(t)-\omega_{2L}(t_i)))^{1/2}\times\sin(\arcsin[(\omega_{1/L}(t)-\omega_{2/L}(t_{i-1}))/2\epsilon_L(t_i)]-\delta\theta_{2L}(t_i)),$$

$$q_{1R}(t)=(4\epsilon_R^2(t_i)-(\omega_{1/R}(t)-\omega_{2/R}(t_i)))^{1/2}\times\sin(\arcsin[(\omega_{1/R}(t)-\omega_{2/R}(t_{i-1}))/2\epsilon_R(t_i)]-\delta\theta_{2R}(t_i)) \tag{25}$$

Wherein, each component of "$\alpha=(\alpha_L, \alpha_R)$" stands for a coefficient denoting systematic stability.

Thereafter, the second angular velocity setting element 135, on the basis of the angular velocity $\omega_{1/}$ of the first virtual oscillator $\phi_1$ set by the first angular velocity setting element 134, sets the angular velocity $\omega_{2/}$ of the second virtual oscillator $\phi_2$ for each component (FIG. 3/S035). Specifically, the second angular velocity setting element 135 set the angular velocity $\omega_2/=(\omega_{2/L}, \omega_{2/R})$ of the second virtual oscillator $\phi_2$ according to the equation (26) so that the second phase difference $\delta\theta_2$ for each component approximates to the desired phase difference $\delta\theta_0$. Subsequently, the angular velocity $\omega_{2/}$ of the second virtual oscillator $\phi_2$ is set as the second intrinsic angular velocity $\omega_2$ (FIG. 3/S036).

$$\omega_{2/L}(t_i)=\beta_L\int dt q_{2L}(t),\ \omega_{2/R}(t_i)=\beta_R\int dt q_{2R}(t)$$

$$q_{2L}(t)=(4\epsilon_L^2(t_i)-(\omega_{1/L}(t)-\omega_{2/L}(t_i)))^{1/2}\times\sin(\arcsin[(\omega_{1/L}(t_i)-\omega_{2/L}(t))/2\epsilon_L(t_i)]-\delta\theta_0),$$

$$q_{2R}(t)=(4\epsilon_R^2(t_i)-\omega_{1/R}(t)-\omega_{2/R}(t_i)))^{1/2}\times\sin(\arcsin[(\omega_{1/R}(t_i)-\omega_{2/R}(t))/2\epsilon_R(t_i)]-\delta\theta_0) \tag{26}$$

Wherein, each component of "$\beta=(\beta_L, \beta_R)$" stands for the coefficient denoting the stability of the system.

Thereafter, the second oscillator generation element 140 generates the second oscillator $\xi_2=(\xi_{2L+}, \xi_{2L-}, \xi_{2R+}, \xi_{2R-})$ as an output oscillation signal from the second model by inputting the second motion oscillator $\phi_2$ determined by the motion oscillator determination element 110 as an input oscillation signal (FIG. 3/S040). The second model is a model representing the correlation between a plurality of second elements including neural elements or the like responsible for motions to the flexion direction (forward direction) and the stretch direction (backward direction) of each leg. As mentioned above, the second model generates an output oscillation signal varying at an angular velocity defined according to the second intrinsic angular velocity $\omega_2$ set by the intrinsic angular velocity setting element 130 on the basis of an input oscillation signal. The second model is defined by the simultaneous differentiation equations represented by, for example, the equation (30). The simultaneous differentiation equations contain therein a state variable $u_i$ (i=L+, L−, R+, R−) and a self-inhibition factor $\nu_i$. The state variable $u_1$ is related to the variation of membrane potentials of the neural elements L+ and L− controlling the motions of the left thigh to the flexion direction (forward direction) and the stretch direction (backward direction) and of the neural elements R+ and R− controlling the motions of the right thigh to the flexion direction (forward direction) and the stretch direction (backward direction). The self-inhibition factor $\nu_j$ denotes compliance of each neural element i.

$$\tau_{1L+}(du_{L+}/dt)=-u_{L+}+w_{L+/L-}\xi_{2L-}+w_{L+/R+}\xi_{2R+}-\lambda_L\nu_{L+}+f_1(\omega_{2L})+f_2(\omega_{2L})K_2\phi_{2L},$$

$$\tau_{1L-}(du_{L-}/dt)=-u_{L-}+w_{L-/L+}\xi_{2L+}+w_{L-/R-}\xi_{2R-}-\lambda_L\nu_{L-}+f_1(\omega_{2L})+f_2(\omega_{2L})K_2\phi_{2L},$$

$$\tau_{1R+}(du_{R+}/dt)=-u_{R+}+w_{R+/L+}\xi_{2L+}+w_{R+/R-}\xi_{2R+}-\lambda_R\nu_{R+}+f_1(\omega_{2R})+f_2(\omega_{2R})K_2\phi_{2R},$$

$$\tau_{1R-}(du_{R-}/dt)=-u_{R-}+w_{R-/L-}\xi_{2L-}+w_{R-/R+}\xi_{2R+}-\lambda_R\nu_{L+}+f_1(\omega_{2R})+f_2(\omega_{2R})K_2\phi_{2R},$$

$$\tau_{2i}(dv_i/dt)=-\nu_i+\xi_{2i},$$

$$\xi_{2i}=H(u_i-u_{th})=0(u_i<u_{thi}) \text{ or } 1(u_i\geqq u_{thi}), \text{ or}$$

$$\xi_{2i}=fs(u_i)=1/(1+\exp(-u_i/D)) \quad (30)$$

"$\tau_{1i}$" is a time constant for defining the variation feature of the state variable $u_i$, which is represented by the equation (31) using a ω-dependant coefficient $t_{(\omega)}$ and a constant $\gamma=(\gamma_L, \gamma_R)$. The time constant varies, depending on the second intrinsic angular velocity $\omega_2$.

$$\tau_{1i}=(t(\omega_{ML})/\omega_{ML})-\gamma_L(i=L+,L-), (t(\omega_{MR})/\omega_{MR})-\gamma_R (i=R+, R-) \quad (31)$$

"$\tau_{2i}$" is a time constant for defining the variation feature of the self-inhibition factor $\nu_i$. "$w_{i/j}$" is a negative second correlation coefficient for representing the correlation of meural elements responsible for the motions of the left and right legs of the human P toward the flexion direction and the stretch direction as the correlation of each component of the second oscillator $\xi_2$ (the correlation between the output oscillation signals of the plurality of second elements). "$\lambda_L$" and "$\lambda_R$" are compliant coefficients. "$\kappa_2$" is a feedback coefficient related to the second motion oscillator $\phi_2$.

"$f_1$" is a linear function of the second intrinsic angular velocity $\omega_2$ defined according to the equation (32) by using the positive coefficient c. "$f_2$" is a quadratic function of the second intrinsic angular velocity $\omega_2$ defined according to the equation (33) by using coefficients $c_0$, $c_1$ and $c_2$.

$$f_1(\omega)\equiv c\omega \quad (32)$$

$$f_2(\omega)\equiv c_0+c_1\omega+c_2\omega_2 \quad (33)$$

The second oscillator $\xi_{2i}$ equals to "0" when the value of the state variable $u_i$ is smaller than a threshold value $u_{th}$; and equals to "1" when the value of the state variable $u_i$ is equal to or greater than the threshold value $u_{th}$. In other words, the second oscillator $\xi_{2i}$ is defined by a sigmoid function fs (refer to equation (30)). According thereto, the second oscillators $\xi_{2L+}$ and $\xi_{2R+}$ serving as the outputs of the second elements (neural elements) L+ and R+ which control the motions of the thigh to the flexion direction (forward direction) become greater than the outputs of the other second elements, respectively. Further, the second oscillators $\xi_{2L-}$ and $\xi_{R-}$ serving as the outputs of the second elements (neural elements) L− and R− which control the motions of the thigh to the stretch direction (backward direction) become greater than the outputs of the other second elements, respectively. The motions toward the forward or backward direction of the leg (thigh) may be recognized by, for example, the polarity of the hip joint angular velocity.

It is acceptable to increase the numbers of the second motion oscillator $\phi_2$, namely the determination object. The more numbers of the second motion oscillators $\phi_2$ are input to the second model, the motions of various body parts of the human P will be more elaborately assisted through regulating the correlation coefficients, although the correlation members in a simultaneous differentiation equation for defining the second model will become more accordingly.

Next, the auxiliary oscillator generation element 150, on the basis of the third motion oscillator $\phi_3$ and the fourth motion oscillator $\phi_4$ determined by the motion oscillator determination element 110, the second oscillator generated by the second oscillator generation element 140, and the second intrinsic angular velocity $\omega_2$ set by the intrinsic angular velocity setting element 130, sets the auxiliary oscillator $\eta=(\eta_L, \eta_R)$. As aforementioned, the auxiliary oscillator η is set on the basis of the hip joint angular velocity determined as the third motion oscillator $\phi_3$ similar to the second motion oscillator $\phi_2$ and the hip joint angle determined as the fourth motion oscillator $\phi_4$ similar to the first motion oscillator $\phi_1$.

Specifically, the first auxiliary oscillator $\eta_1=(\eta_{1L}, \eta_{1R})$ is generated on the basis of third motion oscillator $\phi_3$, the second oscillator $\xi_2$ and the second intrinsic angular velocity $\omega_2$ according to the third motion oscillator $\phi_3$, the fourth motion oscillator $\phi_4$ and the equation (40) (FIG. 3/S051).

$$\eta_{1L}=g_{1+}(\omega_{2L})g_+(\phi_{3L})\xi_{2L+}-g_{1-}(\omega_{2L})g_-(\phi_{3L})\xi_{2L-},$$

$$\eta_{1R}=g_{1+}(\omega_{2R})g_+(\phi_{3R})\xi_{2R+}-g_{1-}(\omega_{2R})g_-(\phi_{3R})\xi_{2R-} \quad (40)$$

"$g_{1+}$" is a cubic function of the second intrinsic angular velocity $\omega_2$ defined according to the equation (41) by using the coefficient $a_{k+}$ (k=0~3). "$g_{1-}$" is a cubic function of the second intrinsic angular velocity $\omega_2$ defined according to the equation (42) by using the coefficient $a_{k-}$ (k=0~3). "$g_+$" is a cubic function of the third motion oscillator $\phi_3$ defined according to C the equation (43) by using the coefficient $c_{i+}$ (i=1, 2) and a desired value in the positive direction (desired value of the hip joint angle in the flexion direction) $\phi_{0+}$ for the value of the third motion oscillator $\phi_3$. "$g_-$" is a cubic function of the third motion oscillator $\phi_3$ defined according to the equation (44) by using the coefficient $c_{i-}$ (i=1, 2) and a desired value in the negative direction (desired value of the hip joint angle in the stretch direction) $\phi_{0-}$ for the value of the third motion oscillator $\phi_3$.

$$g_{1+}(\omega)\equiv\Sigma_{k=1-3}a_{k+}\omega_k \quad (41)$$

$$g_{1-}(\omega)\equiv\tau_{k=1-3}a_{k-}\omega_k \quad (42)$$

$$g_{+}(\phi)\equiv c_{1+}(\phi-\phi_{0+})+c_{2+}(\phi-\phi_{0+})^3 \quad (43)$$

$$g_{-}(\phi)\equiv c_{1-}(\phi-\phi_{0-})+c_{2-}(\phi-\phi_{0-})^3 \quad (44)$$

The $g_{1+}$ and $g_{1-}$ are equivalent to the first coefficient of the present invention. The $a_{k+}$ and $a_{k-}$ (k=0~3) are equivalent to the first parameter of the present invention. The $g_{1+}$ and $g_{1-}$ are equivalent to the third coefficient of the present invention. The $c_{1+}$, $c_{2+}$, $c_{1-}$ and $c_{2-}$ are equivalent to the third parameter of the present invention.

Figure 4:
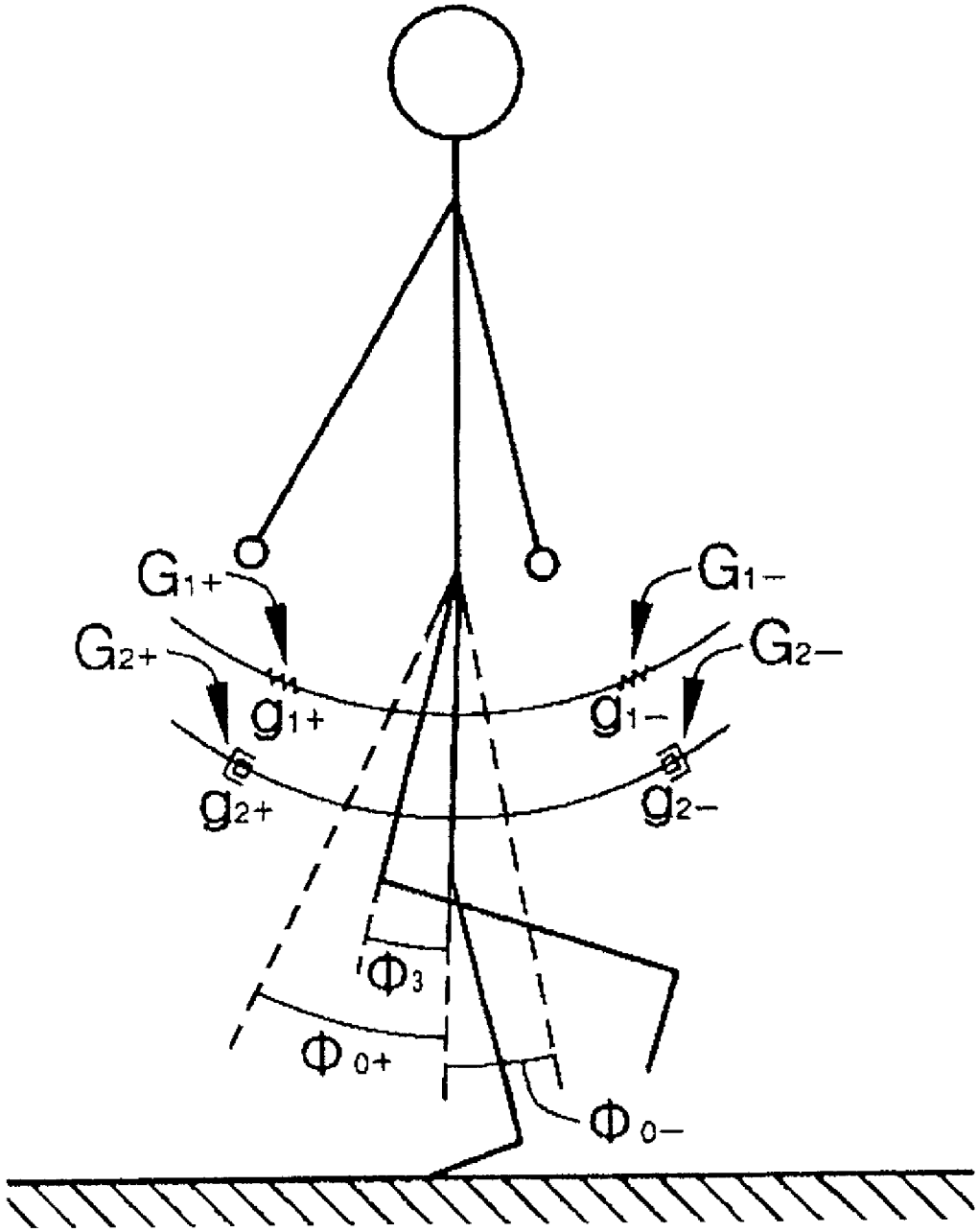
FIG. 4 is an explanatory diagram of a virtual elastic element related to the generation of an auxiliary oscillator.

As illustrated in FIG. 4, the first auxiliary oscillator $\eta_1$ has the first coefficients $g_{1+}$ and $g_{1-}$ as the elastic coefficient and is represented as an elastic force generated from two virtual elastic elements (for example, springs) $G_{1+}$ and $G_{1-}$ for restoring the value of the third motion oscillator $\phi_3$ to the desired value $\phi_{0+}$ in the positive direction and the desired value $\phi_{0-}$ in the negative direction, respectively. The walk motion of the human P can be assisted by the first auxiliary oscillator $\eta_1$ so as to be performed in a motion scale appropriately in consideration of the behavior characteristics of the elastic force generated from the elastic elements, such as the muscle and the like of the human P, when the state of the muscle is transferred from the contracted state to the stretched state.

The "$g_{1+}(\omega_{2L})g_+(\phi_{3L})\xi_{2L+}$" and "$g_{1+}(\omega_{2R})g_+(\phi_{3R})\xi_{2R+}$" of the first auxiliary oscillator $\eta_1$ denote the elastic force of one virtual elastic element $G_{1+}$ applied to the thigh of the human P so as to approximate the value of the third motion oscillator $\phi_3$ to the desired value $\phi_{0+}$ in the positive direction in accordance with the elastic coefficient $g_{1+}$ (refer to equations (40), (41) and (43), and FIG. 4). In other words, the two terms denote the elastic force from the elastic element $G_{1+}$ which moves the thigh forward when the value of the third motion oscillator (the hip joint angle) $\phi_3$ is smaller than the desired value $\phi_{0+}$ in the positive direction and moves the thigh backward when the value of the third motion oscillator $\phi_3$ is greater than the desired value $\phi_{0+}$ in the positive direction. On the other hand, the "$-g_{1-}(\omega_{2L})g-(\phi_{3L})\xi_{2L-}$" and "$-g_{1-}(\omega_{2R})g-(\phi_{3R})\xi_{2R-}$" of the first auxiliary oscillator $\xi_1$ denote the elastic force of one virtual elastic element $G_{1-}$ applied to the thigh of the human P so as to approximate the value of the third motion oscillator $\phi_3$ to the desired value $\phi_{0-}$ in the negative direction in accordance with the elastic coefficient $g_{1-}$ (refer to equations (40), (42) and (44), and FIG. 4). In other words, the two terms denote the elastic force from the elastic element $G_{1-}$ which moves the thigh backward when the value of the third motion oscillator (the hip joint angle) $\phi_3$ is greater than the desired value $\phi_{0-}$ in the negative direction and moves the thigh forward when the value of the third motion oscillator $\phi_3$ is smaller than the desired value $\phi_{0-}$ in the negative direction.

As aforementioned, since the outputs from a part of the plurality of the second elements i (=L+, L−, R+, R−) are overemphasized according to the motions of the thigh to the forward direction and the motions to the backward direction, respectively, the elastic forces from the two virtual elastic elements $G_{1+}$ and $G_{1-}$, respectively, can be prevented from cancelling each other. For example, when the left thigh is moving forward, the value of the second oscillator $\xi_{2L+}$ related to the second element L+ for controlling the forward motion of the left thigh becomes greater than the value of the second oscillator $\xi_{2L-}$ related to the other second element L−, therefore, the first auxiliary oscillator $\eta_{1L}$ is more approximately denoted by the equation (40) than by the equation (45). In other words, when the left thigh is moving forward, the first auxiliary oscillator $\eta_1$ is approximately denoted as the elastic force from the elastic element $G_{1+}$ applied to the left thigh of the human P so as to approximate the value of the third motion oscillator $\phi_3$ to the desired value $\phi_{0+}$ in the positive direction but not the sum of the elastic forces from both of the elastic elements $G_{1+}$ and $G_{1-}$. The same applies to the right thigh. Accordingly, the elastic forces from the two virtual elastic elements $G_{1+}$ and $G_{1-}$ can be prevented from cancelling each other.

$$\eta_{1L}\cong g_{1+}(\omega_{2L})g_+(\phi_{3L})\xi_{2L+} \quad (45)$$

On the other hand, for example, when the left thigh is moving backward, the output from the second element L− for controlling the backward motion of the left thigh becomes greater than the output from the other second element L+, consequently, the value of the second oscillator $\xi_{2L-}$ related to the second element L− becomes greater than the value of the second oscillator $\xi_{2L+}$ related to the other second element L+, therefore, the first auxiliary oscillator $\eta_{1L}$ is more approximately denoted by the equation (40) than by the equation (46). In other words, when the left thigh is moving backward, the first auxiliary oscillator $\eta_1$ is approximately denoted as the elastic force from the other elastic element $G_{1-}$ applied to the left thigh of the human P so as to approximate the value of the third motion oscillator $\phi_3$ to the desired value $\phi_{0-}$ in the negative direction but not the sum of the elastic forces from both of the elastic elements $G_{1+}$ and $G_{1-}$. The same applies to the right thigh. Accordingly, the elastic forces from the two virtual elastic elements $G_{1+}$ and $G_{1-}$ can be prevented from cancelling each other.

$$\eta_{1L}\cong -g_{1-}(\omega_{2L})g_-(\phi_{3L})\xi_{2L-} \quad (46)$$

The desired values $\phi_{0+}$ and $\phi_{0-}$ for the third motion oscillator $\phi_3$ are set according to the desired motion scale such as the footstep or the like and geometrical features for specifying the posture of the leg including the angular velocity of the hip joint of the human P. The functions of the second intrinsic angular velocity ( ), namely the coefficient $a_{k+}$ contained in the first coefficient $g_{1+}(\omega_2)$ and the coefficient $a_{k-}$ contained in the first coefficient $g_{1-}(\omega_2)$, may be set as the coefficients related to the desired motion rhythm such as the walk ratio (=footsteps per unit time). It is acceptable to set the desired values $\phi_{0+}$ and $\phi_{0-}$ for the value of the third motion oscillator $\phi_3$ according to a desired motion scale set by an observer or the like who inspects the walk motion of the human P and the geometrical conditions of the posture of the leg including the angular velocity of the hip joint of the human P via operations performed on the setting buttons (not shown) disposed in the motion assist device 10. It is also acceptable to set the coefficient $a_{k+}$ contained in the first coefficient $g_{1+}(\omega_2)$ and the coefficient $a_{k-}$ contained in the first coefficient $g_{1-}(\omega_2)$ according to a desired walk ratio set by the human P via operations performed on the setting buttons (not shown) disposed in the motion assist device 10.

Hereinafter, the generation process (FIG. 3/S051) for the first auxiliary oscillator $\eta_1$ mentioned above will be described with reference to the flow chart in FIG. 5.

Figure 5:
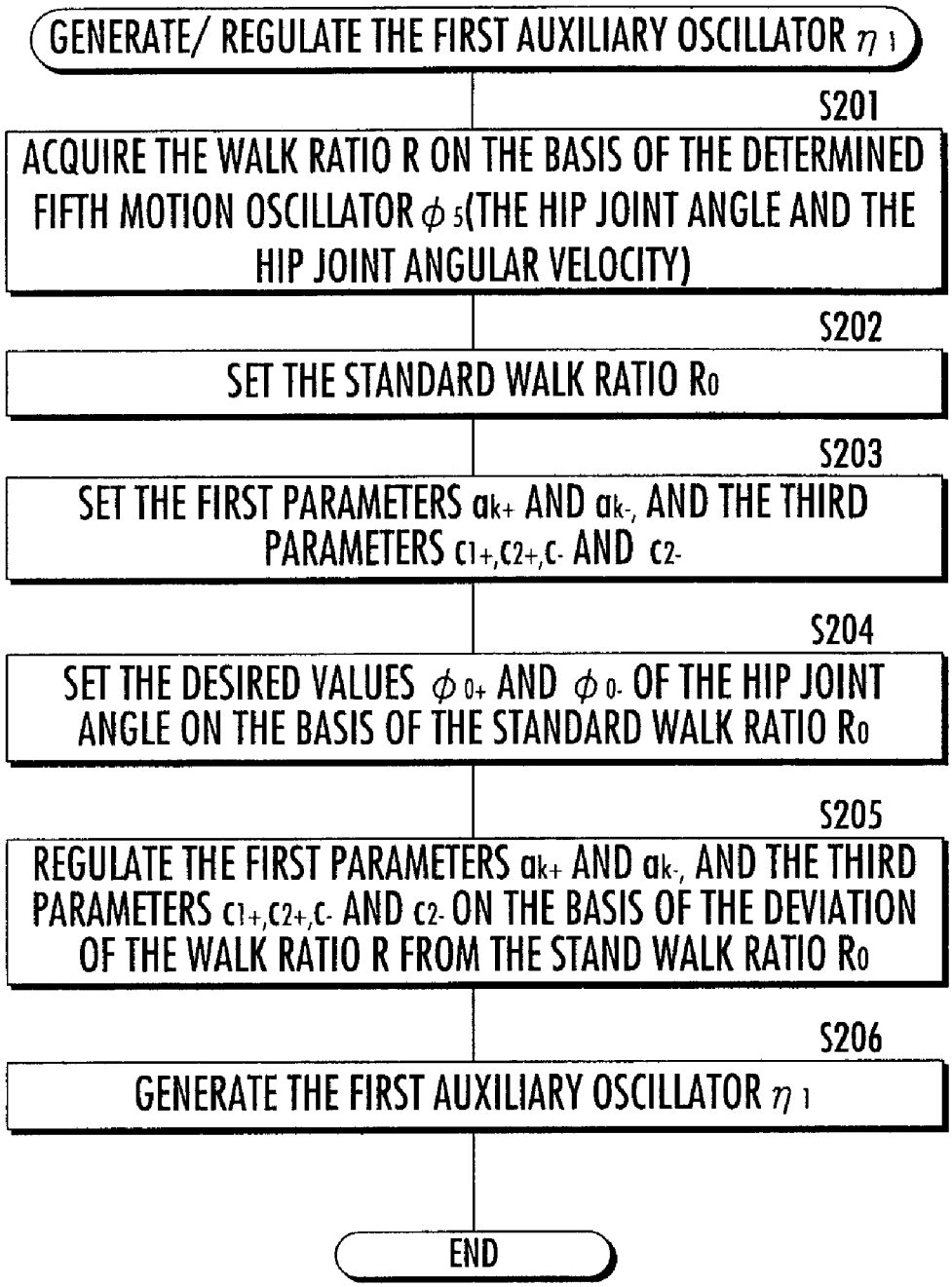
FIG. 5 is a flow chart illustrating a process for generating a first auxiliary oscillator.

First, the motion index value acquiring element 161, on the basis of the fifth motion oscillator (the hip joint angle and the hip joint angular velocity) $\phi_5$ determined by the motion oscillator determination element 110, acquires the walk ratio R (the motion index value of the human P) (FIG. 5/S201). Specifically, the motion index value acquiring element 161 determines the footstep W according to the determined hip joint angle and the geometrical conditions for the posture of the leg of the human P, and determines the walk frequency U (=footsteps/min) according to temporal data of the determined hip joint angular velocity. It is acceptable for the motion index value acquiring element 161 to determine the walk frequency U directly from the footsteps determined by an acceleration sensor or the like disposed therein. Thereafter, the motion index acquiring value element 161 obtains the walk ratio R (=the footstep W/the walk frequency U) using the determined footstep W and the walk frequency U. It is acceptable to use a footstep W determined in each control cycle and an averaged walk frequency U in predefined times of control cycles as the footstep W and the walk frequency U in the present embodiment.

Thereafter, the desired motion setting element 111 sets the standard walk ratio (the reference value of the motion index value of the human P) $R_0$ (FIG. 5/S202). The standard walk ratio $R_0$ is predefined. Herein, it is acceptable for the desired motion setting element 111 to determine the walk state of the human P firstly and set the standard walk ratio $R_0$ through selection from a plurality of predefined values according to the determined walk state. It is also acceptable for the desired motion setting element 111 to set a value input by the human P through the setting buttons (not shown) disposed in the walk assist device 10 as the stand walk ratio $R_0$.

Subsequently, the desired motion setting element 111 sets the coefficients (the first parameters) $a_{k+}$ and $a_{k-}$ related to the desired motion rhythm (walk ratio) contained in the first coefficients $g_{1+}(\omega_2)$ and $g_{1-}(\omega_2)$ which are the functions of the second intrinsic angular velocity $\omega_2$ as illustrated by the equations (41) and (42), respectively. Meanwhile, the desired motion setting element 111 sets the coefficients (the third parameters) $c_{1+}$, $c_{2+}$, and $c_{2-}$ related to the desired motion scale (footstep) contained in the third coefficients $g_+(\phi_3)$ and $g_-(\phi_3)$ which are the functions of the hip joint angle (the third motion oscillator) $\phi_3$ as illustrated by the equations (43) and (44), respectively (FIG. 5/S203).

Herein, it is acceptable for the desired motion setting element 111 to determine the walk state of the human P firstly and set the first parameters $a_{k+}$ and $a_{k-}$ and the third parameters $c_{1+}$, $c_{2+}$, and $c_{2-}$ from a plurality of predefined values through selection according to the determined walk state. It is also acceptable for the desired motion setting element 111 to set a desired walk ratio set by the human P through the setting buttons (not shown) disposed in the walk assist device 10 as the first parameters $a_{k+}$ and $a_{k-}$ and the third parameters $c_{1+}$, $c_{2+}$, $c_{1-}$ and $c_{2-}$.

Then, the desired motion setting element 111 sets the desired values $\phi_{0+}$ and $\phi_{0-}$ for the third motion oscillator (the hip joint angle) $\phi_3$ according to the standard walk ration ratio $R_0$ set at S202 and the geometrical conditions of the posture of the leg including the hip joint angle of the human P (FIG. 5/S204). In detail, the desired motion setting element 111 firstly calculates a desired value $W_0$ (=$R_0$*U) of the footstep W according to the walk frequency U determined at S201 and the standard walk ratio $R_0$ set at S202. Herein, it is acceptable to use an averaged walk frequency U in predefined times of control cycles as the walk frequency U in the present embodiment.

Thereafter, the desired motion setting element 111 calculates the footstep $W_+$ in the stretch direction according to the maximum hip joint angle $\phi_{m+}$ in the stretch direction obtained from the determined third motion oscillator (the hip joint angle) $\phi_3$. Herein, it is acceptable to use an averaged value of the maximum hip joint angle $\phi_{m+}$ in the stretch direction of each control cycle in predefined times of control cycles as the maximum hip joint angle $\phi_{m+}$ in the stretch direction in the present embodiment.

Subsequently, the desired motion setting element 111 calculates the desired value $W_{0-}$ of the footstep $W_-$ in the flexion direction by subtracting the calculated footstep $W_+$ in the stretch direction from the calculated desired footstep $W_0$.

Thereafter, the desired motion setting element 111 calculates the desired value $\phi_{0-}$ of the hip joint angle in the flexion direction according to the calculated desired footstep $W_{0-}$ in the flexion direction and the geometrical conditions of the posture of the leg including the hip joint angle of the human P.

It is acceptable for the desired motion setting element 111 to use an upper limit predefined according to the geometrical conditions of the posture of leg including the hip joint angle of the human P as the desired value $\phi_{0-}$ of the hip joint angle in the stretch direction. The upper limit may be set according to the walk state of the human P. The upper limit may also be set according to the desired footstep set by the human P via the setting buttons (not shown) disposed in the walk assist device 10.

In the present embodiment, the desired value $\phi_{0-}$ of the hip joint angle in the flexion direction is set according to the standard walk ratio $R_0$ and the predefined upper limit is used as the desired value $\phi_{0+}$ of the hip joint angle in the stretch direction. However, it is acceptable to set the desired value $\phi_{0+}$ of the hip joint angle in the stretch direction according to the standard walk ratio $R_0$ and use the predefined upper limit as the desired value $\phi_{0-}$ of the hip joint angle in the flexion direction. For example, when the motion index value is a footstep, a hip joint angle or the like set independently in the flexion direction and the stretch direction, it is possible to set the desired values $\phi_{0+}$ and $\phi_{0-}$ of the hip joint angles independently in the flexion direction and the stretch direction in a spring model related to the flexion direction and the stretch direction, respectively.

Thereafter, the auxiliary oscillator regulation element 160 regulates the first parameters $a_{k+}$ and $a_{k-}$ (k=1~3) set at S203 and the third parameters $c_{1+}$, $c_{2+}$, $c_{1-}$ and $c_{2-}$ (FIG. 5/S205). Here, the auxiliary oscillator regulation element 160, on the basis of a deviation of the walk ratio R acquired at S201 from the standard walk ratio $R_0$ set at S202, regulates the parameters $a_{k+}$, $a_{k-}$, $c_{2+}$, $c_{1-}$ and $c_{2-}$. Specifically, similar to the approach which sequentially sets the correlation coefficient $\epsilon$ according to the equation (24) so that the deviation between the first phase difference $\delta\theta_1$ and the second phase difference $\delta\theta_2$ is minimum, the parameters $a_{k+}$, $a_{k-}$, $c_{1+}$, $c_{2+}$, $c_{1-}$ and $c_{2-}$ are sequentially set so that the deviation of the walk ratio R from the standard walk ratio $R_0$ is minimum. In other words, the auxiliary oscillator regulation element 160 makes the parameters $a_{k+}$, $a_{k-}$, $c_{1+}$, $c_{2+}$, $c_{1-}$ and $c_{2-}$ vary from the set values so as to approximate the walk ratio R to the stand walk ratio $R_0$. Note that the parameters $a_{k+}$, $a_{k-}$, $c_{2+}$, $C_{1-}$ and $c_{2-}$ are regulated every predefined times of control cycles (for example, every three steps) other than every control cycle (for example, every step).

The auxiliary oscillator regulation element 160 sequentially regulates at least either one parameter in the parameter set composed of the plurality of parameters, namely, the first parameters $a_{k+}$ and $a_{k-}$, and the third parameters $c_{1+}$, $C_{2+}$, $c_{1-}$ and $c_{2-}$.

When the footstep W related to the walk ratio R denoting a balance between the motion rhythm and the motion scale of the human P is used as the motion index value, the auxiliary oscillator regulation element 160 regulates the parameters $a_{k+}$, $a_{k-}$, $c_{1+}$, $c_{2+}$, $c_{1-}$ and $c_{2-}$ so as to approximate the footstep W to a standard footstep $W_0$ derived from the standard walk ratio $R_0$. When a footstep, a hip joint angle or the like set independently in the flexion direction and the stretch direction is used as the motion index value, the parameters $a_{k+}$, $a_{k-}$, $c_{1+}$, $c_{2+}$, $C_{1-}$ and $c_{2-}$ are regulated independently in the flexion direction and the stretch direction.

Thereafter, the auxiliary oscillator generation element 150 calculates the first coefficients $g_{1+}$ and $g_{1-}$ and the third coefficients $g_+$ and $g_-$ by assigning the third motion oscillator (the hip joint angle) $\phi_3$, the second intrinsic angular velocity $\omega_2$, the desired values $\phi_{0+}$ and $\phi_{0-}$ of the hip joint angle set at S204, and the parameters $a_{k+}$, $a_{k-}$, $c_{1+}$, $c_{2+}$, $c_{1-}$ and $c_{2-}$ regulated at S205 to the equations of (41) to (44); and thereafter generates the first auxiliary oscillator $\eta_1$ by assigning the calculated first coefficients $g_{1+}$ and the calculated third coefficients $g_+$ and $g_-$, and the calculated second intrinsic angular velocity $\omega_2$ to the equation (40) (FIG. 5/S206).

The mentioned is the process for generating the first auxiliary oscillator $\eta_1$.

Note that a sigmoid function fs (refer to the equation (30)) using the value of the third motion oscillator $\phi_3$ as a variable may be incorporated into the first coefficients $g_{1+}$ and $g_{1-}$, thereby, the first auxiliary oscillator $\eta_1$ may be generated in a form that a part of the second oscillators $\xi_{2i}$ serving as the outputs of the plurality of the second elements i are overemphasized according to the motions to the forward and backward directions of the thigh. Herein, the motions of the thigh to the forward and backward directions may be specified according to the polarity of a first order temporal differentiation $d\phi_3/dt$ over the third motion oscillator $\phi_3$, respectively. According thereto, the elastic forces from the two virtual springs $G_{1+}$ and $G_{1-}$ can be prevented from cancelling each other.

Subsequently, the second auxiliary oscillator $\eta_2$ is set according to the fourth motion oscillator $\phi_4$ determined by the motion oscillator determination element 110, the second oscillator $\xi_2$ generated by the second oscillator generation element 140, the second intrinsic angular velocity $\omega_2$ set by the intrinsic angular velocity setting element 130, and the equation (50) (FIG. 3/S052).

$$\eta_{2L}=-g_{2+}(\omega_{2L})\phi_{4L}H_+(\int dt\phi_{4L})\xi_{2L+}+g_{2-}(\omega_{2L})\phi_{4L}H_-(\int dt\phi_{4L})\xi_{2L-},$$

$$\eta_{2R}=-g_{2+}(\omega_{2R})\phi_{4R}H_+(\int dt\phi_{4R})\xi_{2R+}+g_{2-}(\omega_{2R})\phi_{4R}H_-(\int dt\phi_{4R})\xi_{2R-} \quad (50)$$

"$g_{2+}$" is a cubic function of the second intrinsic angular velocity $\omega_2$ defined according to the equation (51) by using the coefficient $b_{k+}$ (k=0~3). "$g_{2-}$" is a cubic function of the second intrinsic angular velocity $\omega_2$ defined according to the equation (52) by using the coefficient $b_{k-}$ (k=0~3). "$H_+$" is a function of a first order temporal integration over the fourth motion oscillator $\phi_4$ defined according to the equation (53). "$H_-$" is a function of a first order temporal integration over the fourth motion oscillator $\phi_4$ defined according to the equation (54).

$$g_{2+}(\omega)\equiv\Sigma_{k=1\sim3}b_{k+}\omega^k \quad (51)$$

$$g_{2-}(\omega)\equiv\Sigma_{k=1\sim3}b_{k-}\omega^k \quad (52)$$

$$H_+(\phi)\equiv0(\phi\leqq0),1(\phi>0) \quad (53)$$

$$H_-(\phi)\equiv0(\phi>0),1(\phi\leqq0) \quad (54)$$

The second auxiliary oscillator $\eta_2$ takes the second coefficients g2+ and g2− as a damping coefficient, respectively. The second auxiliary oscillator $\eta_2$ is denoted as a damping force of two virtual damping elements (for example, dampers) $G_{2+}$ and $G_{2-}$ illustrated in FIG. 5. The two virtual damping elements (for example, dampers) $G_{2+}$ and $G_{2-}$ are configured to prevent the absolute value of the temporal integration thereof from increasing according to the fourth motion oscillator $\phi_4$. Therefore, the walk motion of the human P can be assisted on the basis of the first auxiliary oscillator $\eta_1$ in consideration of the behavior characteristics (such as the elastic force or the like generated when a muscle moves from the contracted state to the relaxed state) of a damping element such as the muscle of the human P.

The $-g_{2+}(\omega_{2L})\phi_{4L}H_+(\int dt\phi_{4L})\xi_{2L+}$ and $-g_{2+}(\omega_{2R})\phi_{4R}H_+(\int dt\phi_{4R})\xi_{2R+}$ of the second auxiliary oscillator $\eta_2$ denote the elastic force which is applied to the thigh of the human P from the virtual elastic element $G_{2+}$ so as to prevent the absolute value of the temporal integration of the fourth motion oscillator $\phi_4$ in the positive direction from increasing according to the damping coefficient $g_{2+}$ and the value of the fourth motion oscillator $\phi_4$ (refer to equations (50), (51) and (53), and FIG. 4). In other words, the terms denote the damping force of the damping element $G_{2+}$ which inhibits the motion of the thigh to the forward direction harder as the value of the fourth motion oscillator (the hip joint angular velocity) $\phi_4$ becomes greater in the positive direction. On the other hand, the $g_{2-}(\omega_{2L})\phi_{4L}H_-(\int dt\phi_{4L})\xi_{2L-}$ and $g_{2-}(\omega_{2R})\phi_{4L}H_-(\int dt\phi_{4R})\xi_{2R-}$ of the second auxiliary oscillator $\eta_2$ denote the elastic force which is applied to the thigh of the human P from the other virtual elastic element $G_{2-}$ so as to prevent the absolute value of the temporal integration of the fourth motion oscillator $\phi_4$ in the negative direction from increasing according to the damping coefficient $g_{2-}$ (refer to equations (50), (52) and (54), and FIG. 4). In other words, the terms denote the damping force of the damping element $G_{2-}$ which inhibits the motion of the thigh to the backward direction harder as the value of the fourth motion oscillator (the hip joint angular velocity) $\phi_4$ becomes greater in the negative direction.

The second auxiliary $\eta_2$ includes step functions $H_+$ and $H_-$ serving as the functions of the hip joint angle $\phi_H$. Thereby, the damping forces from the two virtual dampers $G_{2+}$ and $G_{2-}$ can be prevented from cancelling each other.

The coefficients $b_{k+}$ and $b_{k-}$ contained respectively in the second coefficients $g_{2+}(\omega_2)$ and $g_{2-}(\omega_2)$ serving as the functions of the second intrinsic angular velocity $\omega_2$ may be set as coefficients related to the desired motion rhythm such as the walk ratio and the like. The coefficients $b_{k+}$ and $b_{k-}$ may also be set by the human P through the setting buttons (not shown) disposed in the motion assist device 10.

The auxiliary oscillator generation element 150 generates the auxiliary oscillator $\eta$ as a sum ($\eta=\eta_1+\eta_2$) of the first auxiliary oscillator $\eta_1=(\eta_{1L}, \eta_{1R})$ generated by the first auxiliary oscillator generation element 151 and the second auxiliary oscillator $\eta_2=(\eta_{2L}, \eta_{2R})$ generated by the second auxiliary oscillator generation element 152 (FIG. 3/S053). On the basis of the auxiliary oscillator $\eta$, the first controller 100 adjusts a current $I=(I_L, I_R)$ supplied from the battery 16 to each of the left and right the actuators 14 (or motors constituting the actuators). The current I is represented by, for example, $I(t)=G_1\cdot\eta(t)$ (wherein, $G_1$ is a constant) on the basis of the auxiliary oscillator $\eta$. Thereby, the force or the torque $T=(T_L, T_R)$ around the hip joint applied to the human P from the motion assist device 10 via the first orthosis 11 and the second orthosis 12 for making the left and right thighs (the second body part) move relatively in the anteroposterior direction with respect to the waist (the first body part) is adjusted (FIG. 3/S060). The torque T is represented by, for example, $T(t)=G_2\cdot I(t)$ (wherein, $G_2$ is a constant) on the basis of the current I. Thereafter, whether a control terminating condition, such as the residual power of the battery 16 is equal to or less than a threshold or an operation switch has been switched from ON to OFF, is satisfied is determined (FIG. 3/S062). If the control terminating condition is not satisfied (FIG. 3/S062 . . . NO), the series of the aforementioned processes are performed repeatedly (refer to FIG. 3/S011, S012, S020 and so on). Accordingly, the walk motion of the human P involving relative motions between the waist (the first body part) and the left and right thighs (the second body part) can be assisted continuously by the motion assist device 10. On the other hand, if the control terminating condition has been satisfied (FIG. 3/S062 . . . YES), the series of the aforementioned processes are terminated.

According to the walk assist system 1 of the present invention with the aforementioned functions, the outputs from the actuators 14 are applied to the waist (the first body part) and the left and right thighs (the second body part) of the human P, respectively. As a result, the walk motion of the human P involving relative motions between the two parts is assisted so as to match the motion scale and the motion rhythm to the desired motion scale and the desired motion rhythm, respectively.

The motion of the human P is assisted by the motion assist device 10 so as to match the motion rhythm of the human P to the desired motion rhythm according to the following reasons. Specifically, the first oscillator $\xi_1$ generated according to the first motion oscillator $\phi_1$ and the first model varies periodically with an angular velocity defined on the basis of the first intrinsic angular velocity $\omega_1$ while harmonizing with the angular velocity of the first motion oscillator $\phi_1$ according to the "mutual entrainment" which is a property of the first model (refer to the equation (10), FIG. 3/S020). Thereby, the auxiliary oscillator $\eta$ can be generated immediately to harmonize the periodical motion of the human P denoted by the first motion oscillator $\phi_1$ through a direct generation on the basis of the first oscillator $\xi_1$.

On the other hand, the phase difference between the periodical motions of the human P represented by the first motion oscillator $\phi_1$ and the periodical operations of the motion assist device 10 represented by the auxiliary oscillator $\eta$ determines the motion behavior of the human P with respect to the operations of the motion assist device 10. For example, when the phase difference is positive, the human P moves in a way of leading the motion assist device 10. On the other hand, when the phase difference is negative, the human P moves in a way of being led by the motion assist device 10. Therefore, the deviation of the phase difference (the first phase difference) $\delta\theta_1$ of the first oscillator $\xi_1$ with respect to the first motion oscillator $\phi_1$ from the desired phase difference $\delta\theta_0$ will make the motion behavior of the human P unstable. Consequently, there is a high probability that the motion rhythm of the human P whose relative motions between the waist and the thigh assisted by the torque T varying periodically at an angular velocity in accordance with the auxiliary oscillator $\eta$ would deviate from the desired motion rhythm.

Thus, after the second oscillator $\xi_2$ is generated, the auxiliary oscillator $\eta$ is generated on the basis of the second oscillator $\xi_2$ but not the first oscillator $\xi_1$ (refer to FIG. 3/S040, S051 to S053). Then, the second intrinsic angular $\omega_2$ for specifying the angular velocity of the second oscillator $\xi_2$ is set appropriately in consideration of matching the motion rhythm of the human P to the desired motion rhythm while maintaining the harmonization between the first motion oscillator $\phi_1$ and the first oscillator $\xi_1$. In other words, an appropriate second intrinsic angular velocity $\omega_2$ is set from the viewpoint of maintaining an appropriate phase difference between an assist rhythm of the motion assist device 10 and a motion rhythm of the human P for matching the motion rhythm of the human P to a desired motion rhythm thereof while harmonizing the assist rhythm of the motion assist device 10 with the motion rhythm of the human P.

Specifically, the correlation coefficient $\epsilon$ for specifying the characteristics of the virtual model and the angular velocity $\omega_1$/ of the first virtual oscillator $\phi_1$ are set in a way that the deviation between the phase difference (the first phase difference) $\delta\theta_1$ of the first motion oscillator $\phi_1$ and the first oscillator $\xi_1$ and the phase difference (the second phase difference) $\delta\theta_2$ of the first virtual oscillator $\phi_1$ and the second virtual oscillator $\phi_2$ becomes minimum (refer to FIG. 3/S033 and S034). According thereto, the virtual model is constructed to denote appropriately the behavior states of the first virtual oscillator $\phi_1$ and the second virtual oscillator $\phi_2$, respectively, in consideration of the mutual harmony (the property of the first model) between the first motion oscillator $\phi_1$ and the first oscillator $\xi_1$. In other words, the virtual model is constructed in a way that the first motion oscillator $\phi_1$ denoted by the first virtual oscillator $\phi_1$ and the auxiliary oscillator $\eta$ denoted by the second virtual oscillator $\phi_2$ or the second oscillator on the basis of which the auxiliary oscillator $\eta$ is generated will vary periodically with the second phase difference $\delta\theta_2$ while harmonizing with each other. The angular velocity $\omega_2$/ of the second virtual oscillator $\phi_2$ is set so as to approximate the second phase difference $\delta\theta_2$ to the desired phase difference $\delta\theta_0$ (refer to FIG. 3/S035). According thereto, the angular velocity $\omega_2$/of the second virtual oscillator $\phi_2$ is set appropriately from the viewpoint of approximating the phase difference between the first motion oscillator $\phi_1$ and the auxiliary oscillator $\eta$ or the second oscillator $\xi_2$ on the basis of which the auxiliary oscillator $\eta$ is generated to the desired phase difference $\delta\theta_0$ while maintaining the mutual harmony between the first motion oscillator $\phi_1$ denoted by the first virtual oscillator $\phi_1$ and the auxiliary oscillator $\eta$ denoted by the second virtual oscillator $\phi_2$ or the second oscillator $\xi_2$ on the basis of which the auxiliary oscillator $\eta$ is generated. The angular velocity $\omega_2$/ of the second virtual oscillator $\phi_2$ is set as the second intrinsic angular velocity $\omega_2$ for specifying the angular velocity of the second oscillator $\xi_2$ serving as the generation basis of the auxiliary oscillator $\xi$ which is quasi-represented by the second virtual oscillator $\phi_2$ (refer to FIG. 3/S035, S051 and S052).

Since the second oscillator $\xi_2$ varies periodically at an angular velocity defined according to the second intrinsic angular velocity $\omega_2$, and the auxiliary oscillator $\eta$ is generated according to the second oscillator $\xi_2$, therefore, the auxiliary oscillator $\eta$ also varies periodically at the angular velocity defined according to the second intrinsic angular velocity $\omega_2$ (refer to the equations (30), (40) and (50), and FIG. 3/S040 and S050). Thereby, the torque T based on the auxiliary oscillator $\eta$ is applied to the human P (refer to FIG. 3/S060) to assist the walk motion of the human P by harmonizing the motion rhythm of the human P with the operation rhythm of the motion assist device 10 and matching the motion rhythm to the desired motion rhythm.

The motion assist device 10 assists the motion of the human P to match the motion scale of the human P to the desired motion scale on the basis of the following reasons. Specifically, as mentioned above, the first auxiliary oscillator $\eta_1$ denotes the elastic force of the virtual elastic element applied to the left and right thighs to approximate the third motion oscillator (the hip joint angle) $\phi_3$ to the desired value $\phi_{0+}$ in the positive direction and the desired value $\phi_{0-}$ in the negative direction, respectively (refer to the equations (40) to (46)). Further, as mentioned above, the second coefficients $g_{2+}$ and $g_{2-}$ contained in the second auxiliary oscillator $\eta_2$ denotes the damping force of the virtual damping element applied to the left and right thighs to prevent the absolute value of the first order temporal integration over the fourth motion oscillator $\phi_4$ (the hip joint angular velocity) from increasing according to the value of the fourth motion oscillator $\phi_4$. Thereby, the torque T based on the auxiliary oscillator $\eta$, the sum of the first auxiliary oscillator $\eta_1$ and the second auxiliary oscillator $\eta_2$, is applied to the human P to assist the walk motion of the human P by approximating the motion scale of the human P denoted by the third motion oscillator $\phi_3$ to the desired motion scale denoted by the desired value $\phi_{0+}$ in the positive direction and the desired value $\phi_{0-}$ in the negative direction and preventing the motion rhythm of the human P from deviating from the desired motion rhythm according to the virtual inhibition force denoted by the fourth motion oscillator $\phi_4$.

Herein, on the basis of the reference value of the motion index value related to the balance between the motion rhythm and the motion scale of the human P, the desired values $\phi_{0+}$ and $\phi_{0-}$ related to the desired motion scale of the human P are set (FIG. 5/S204). Meanwhile, the parameters ($a_{k+}$, $a_{k-}$, $c_{1+}$, $c_{2+}$, $c_{1-}$, $c_{2-}$) for the first coefficient and the third coefficient which are used in calculating the first auxiliary oscillator $\eta_1$ are sequentially regulated so as to approximate the motion index value of the human P to the reference value (FIG. 5/S205). In other words, this means that the elastic force generated by the virtual elastic element for assisting the motion of the human P is regulated sequentially so as to approximate the motion index value related to the balance between the motion rhythm and the motion scale of the human P to the reference value.

As mentioned, according to the walk assist device (the motion assist device) 10 of the present invention, the motion of the user can be assisted so as to match the motion rhythm and scale of the user to the desired motion rhythm and scale thereof. Moreover, according to the motion assist device 10 of the present invention, by regulating sequentially the first auxiliary oscillator denoting the elastic force generated by the virtual elastic element for assisting the motion of the user so as to match the motion scale of the user to the desired motion scale thereof so as to approximate the motion index value related to the balance between the motion rhythm and the motion scale of the user to the reference value, the motion of the user can be assisted to maintain the balance the motion rhythm and the motion scale of the user.

In the present embodiment, the torque $T=(T_L, T_R)$ around the left and right hip joints in relation to the auxiliary oscillator $\eta$ is described to be applied to the body of the user. However, it is acceptable to apply a torque around different joint, such as the knee joint, the ankle joint, the shoulder joint, the elbow joint, or the wrist joint, to the body of the user. The combination of joints serving as the subject of the torque may be varied in relation to the user.

As another embodiment, periodical sounds in relation to the auxiliary oscillator $\eta$ which may be heard by a pedestrian through an auditory device (not shown) such as a headphone or the like, periodical lights or signs in relation to the auxiliary oscillator $\eta$ which may be seen via a visual device (not shown) such as a goggle or the like, periodical knocks in relation to the auxiliary oscillator $\eta$ which may be sensed by a part of the body, such as the back or shoulder of the user through a massage machine or the like, may be applied to the user.

In the present embodiment, the motion assist device 10 is configured to assist the walk motion of the human P (refer to FIG. 1). However, as another embodiment, it is acceptable to configure the motion assist device 10 to be able to assist various motions beside the walk motion by varying the shape or materials of the first orthosis 11 and the second orthosis 12 so that they can be mounted to various body parts of the human P. For example, the first orthosis 11 and the second orthosis 12 may be mounted to the thigh (the first body part) and the crus (the second body part) of the human P, respectively, to assist the periodical motions of the crus relative to the thigh. Further, the first orthosis 11 and the second orthosis 12 may be mounted to the forearm (the first body part) and the thigh (the second body part) of the human P, respectively, to assist the periodical motions of the thigh relative to the forearm. Furthermore, the first orthosis 11 and the second orthosis 12 may be mounted to the shoulder (the first body part) and the forearm (the second body part) of the human P, respectively, to assist the periodical motions of the forearm relative to the shoulder. The motion assist device 10 may also be configured as to assist hand operations related to the manufacture of products such as vehicles or the like. Accordingly, by following the auxiliary oscillator, the human P can perform the operations with a desired motion rhythm and scale (or adjustment of strength). Moreover, when the desired motion rhythm and scale are defined according to the hand operations by a skilled worker, the human P can feel the subtle hand motions or the adjustment of strength performed by the skilled worker, and consequently, to master the skill earlier.

As another embodiment, it is acceptable for the motion assist device to have a body weight relieving device configured to adjust an upward force applied to the human P. As the body weight relieving device, a device configured to adjust strength of the upward force applied to the human P through adjusting the tension of a wire fixed at the human P may be used, for example. According to the motion assist system 1 with the mentioned configuration, by applying an adjustable upward force to the human P through the body weight relieving device, the load on legs of the human P for supporting the body weight thereof can be reduced.

As another embodiment, it is acceptable for the motion assist device to have a treadmill on which the human P performs the walk motion. The treadmill is provided with two rollers, a circular belt to be wrapped on the two rollers, a support member for supporting the body weight of the human P from the back surface of the belt, a driving mechanism for driving one of the two rollers, and a controller for controlling the driving mechanism. It is possible for the human P to perform the walk motion or walk training even in a relatively narrower space through the use of the treadmill.

What is claimed is:

1. A motion assist device configured to assist a motion of a user according to an auxiliary oscillator serving as a parameter which varies temporally for determining an assist force which varies temporally applied to the user in order to assist the motion of the user, comprising:

a motion oscillator determination element configured to determine a first and a second motion oscillators serving as parameters which vary temporally according to physical motions of the user, and a third motion oscillator serving as a parameter which varies temporally according to physical motions of the user and denotes a motion scale of the user;

a first oscillator generation element configured to generate a first oscillator as an output oscillation signal from a first model by inputting the first motion oscillator determined by the motion oscillator determination element as an input oscillation signal to the first model, the first model generates the output oscillation signal varying temporally at a specific angular velocity defined on the basis of a first intrinsic angular velocity by entraining to the input oscillation signal;

an intrinsic angular velocity setting element configured to set an angular velocity of a second virtual oscillator as a second intrinsic angular velocity on the basis of a virtual model denoting a first virtual oscillator and a second virtual oscillator which interact with each other and vary periodically with a second phase difference and a first phase difference between the first motion oscillator determined by the motion oscillator determination element and the first oscillator generated by the first oscillator generation element so as to approximate the second phase difference to a desired phase difference;

a second oscillator generation element configured to generate a second oscillator as an output oscillation signal from a second model by inputting the second motion oscillator determined by the motion oscillator determination element as an input oscillation signal to the second model, the second model generates the output oscillation signal varying temporally at a specific angular velocity defined on the basis of the second intrinsic angular velocity set by the intrinsic angular velocity setting element according to the input oscillation signal;

an auxiliary oscillator generation element configured to generate an auxiliary oscillator on the basis of the second oscillator generated by the second oscillator generation element and the second intrinsic angular velocity set by the intrinsic angular velocity setting element, the auxiliary oscillator includes therein a first auxiliary oscillator denoting an elastic force originated from a virtual elastic element for assisting the motion of the user so as to approximate a value of the third motion oscillator determined by the motion oscillator determination element to a desired value related to a desired motion scale of the user;

a motion index value acquiring element configured to acquire a motion index value related to a balance between a motion rhythm and a motion scale of the user; and an auxiliary oscillator regulation element configured to sequentially regulate the first auxiliary oscillator generated by the auxiliary oscillator generation element so as to approximate the motion index value acquired by the motion index value acquiring element to a reference value.

2. The motion assist device according to claim 1, wherein the auxiliary oscillator generation element generates the first auxiliary oscillator including therein an oscillator which is calculated as a product of a first coefficient, a third coefficient and the second oscillator;

the first coefficient serves as the elastic coefficient of the virtual elastic element and is a function of a first parameter and the second intrinsic angular velocity set by the intrinsic angular velocity setting element;

the third coefficient is a function of a third parameter and a deviation of the value of the third motion oscillator from the desired value; and wherein the auxiliary oscillator regulation element, on the basis of a deviation of the motion index value from the reference value of the motion index value, sequentially regulates at least one of the first parameter for calculating the first coefficient and the third parameter for calculating the third coefficient so as to approximate the motion index value to the reference value.

3. The motion assist device according to claim 1 further including a setting element for setting the reference value of the motion index value according to an operation from the user or a motion state of the user.

4. The motion assist device according to claim 1 further including a setting element for setting the desired value related to the desired motion scale of the user according to the reference value of the motion index value.

5. The motion assist device according to claim 1, wherein the motion of the user is performed respectively at a left side and a right side of the user; and the auxiliary oscillator regulation element sequentially regulates the first auxiliary oscillator so as to approximate the motion index value of the user to the reference value for the motion performed respectively at the left side and the motion performed at the right side.

6. The motion assist device according to claim 1, wherein the motion of the user is composed of a motion in a flexion direction and a motion in a stretch direction; and the auxiliary oscillator regulation element sequentially regulates the first auxiliary oscillator so as to approximate the motion index value of the user to the reference value for the motion in the flexion direction and the motion in the stretch direction of the user, respectively.

* * * * *